US009816353B2

(12) United States Patent
Rashid et al.

(10) Patent No.: US 9,816,353 B2
(45) Date of Patent: Nov. 14, 2017

(54) METHOD OF OPTIMIZATION OF FLOW CONTROL VALVES AND INFLOW CONTROL DEVICES IN A SINGLE WELL OR A GROUP OF WELLS

(71) Applicant: SCHLUMBERGER TECHNOLOGY CORPORATION, Sugar Land, TX (US)

(72) Inventors: Kashif Rashid, Newton Center, MA (US); William J. Bailey, Somerville, MA (US); Benoit Couet, Belmont, MA (US); Terry Wayne Stone, Kings Worthy (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 545 days.

(21) Appl. No.: 13/830,376

(22) Filed: Mar. 14, 2013

(65) Prior Publication Data

US 2014/0262235 A1 Sep. 18, 2014

(51) Int. Cl.
*E21B 34/16* (2006.01)
*E21B 43/12* (2006.01)

(52) U.S. Cl.
CPC ..... *E21B 34/16* (2013.01); *E21B 43/12* (2013.01)

(58) Field of Classification Search
USPC ..... 703/9, 10
See application file for complete search history.

(56) References Cited

U.S. PATENT DOCUMENTS

| | | | | |
|---|---|---|---|---|
| 7,818,156 | B2 * | 10/2010 | Vachhani | C10G 7/10 208/47 |
| 2007/0179766 | A1 * | 8/2007 | Cullick | E21B 43/00 703/10 |
| 2007/0198223 | A1 | 8/2007 | Ella et al. | |

FOREIGN PATENT DOCUMENTS

| | | | |
|---|---|---|---|
| GB | 2368600 | A | 5/2002 |
| WO | 02/063130 | A1 | 8/2002 |
| WO | 2006/003118 | A1 | 1/2006 |
| WO | 2012031089 | A2 | 3/2012 |

OTHER PUBLICATIONS

Bellout, et al., "Joint optimization of oil well placement and controls", Computational Geosciences, vol. 16, Issue 4, Sep. 2012, pp. 1061-1079.

Volcker, "Oil reservoir production optimization using optimal control", 50th IEEE Conference on Decision and Control and European Control Conference, CDC-ECC 2011, Dec. 12-15, 2011, pp. 7937-7943.

Rashid, et al., "An adaptive multi-quadric radial basis function method for expensive mixed-integer nonlinear problems", Engineering Optimization, vol. 45(2), 2013, pp. 185-206.

Examination Report for GB application 1403061.3 dated Dec. 22, 2016.

Examination Report issued in related GB application GB1403061.3 dated Mar. 8, 2016, 18 pages.

* cited by examiner

*Primary Examiner* — Kyle Armstrong
(74) *Attorney, Agent, or Firm* — Alec J. McGinn

(57) ABSTRACT

A method and an apparatus for managing a subterranean formation including collecting information about a flow control valve in a wellbore traversing the formation, adjusting the valve in response to the information wherein the adjusting includes a Newton method, a pattern search method, or a proxy-optimization method. In some embodiments, adjusting comprises changing the effective cross sectional area of the valve. A method and an apparatus for managing a subterranean formation including collecting information about an inflow control valve in a wellbore traversing the reservoir and controlling the valve, wherein the control includes a direct-continuous approach or a pseudo-index approach.

23 Claims, 15 Drawing Sheets

CONFIG_DC2 =

| | | | | | | | |
|---|---|---|---|---|---|---|---|
| 0 | 0 | 0 | 0 | 1 | 3 | 1 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 0 | 0 | 0 | 0 | 0 | 0 | 0 | 1 |

*FIG. 13*

CONFIG_PI2 =

| | | | | | | | |
|---|---|---|---|---|---|---|---|
| 0 | 0 | 1 | 1 | 2 | 2 | 1 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 3 | 3 | 3 | 3 | 3 | 3 | 3 | 3 |
| 3 | 3 | 3 | 3 | 3 | 3 | 3 | 3 |
| 0 | 0 | 0 | 0 | 3 | 3 | 3 | 3 |
| 3 | 3 | 3 | 3 | 3 | 3 | 3 | 3 |
| 0 | 0 | 0 | 1 | 3 | 3 | 3 | 3 |
| 3 | 3 | 3 | 3 | 3 | 3 | 3 | 3 |
| 3 | 3 | 3 | 3 | 3 | 3 | 3 | 3 |
| 0 | 0 | 0 | 0 | 3 | 3 | 3 | 3 |

*FIG. 14*

CONFIG_DC4 =

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 1 | 2 | 3 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 |
| 1 | 3 | 1 | 1 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 |
| 0 | 0 | 0 | 0 | 0 | 0 | 0 | 0 | 0 | 0 | 0 | 0 | 0 | 0 | 0 | 1 |

CONFIG_PI4 =

| | | | | | | | | | | | | | | | |
|---|---|---|---|---|---|---|---|---|---|---|---|---|---|---|---|
| 0 | 0 | 0 | 0 | 0 | 0 | 0 | 0 | 3 | 3 | 3 | 3 | 3 | 3 | 3 | 3 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 3 | 3 | 3 | 3 |
| 0 | 0 | 0 | 0 | 0 | 0 | 0 | 0 | 0 | 0 | 0 | 0 | 3 | 3 | 3 | 3 |
| 3 | 3 | 3 | 3 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 |
| 0 | 0 | 0 | 0 | 3 | 3 | 3 | 3 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 |
| 0 | 0 | 0 | 0 | 0 | 0 | 0 | 0 | 3 | 3 | 3 | 3 | 3 | 3 | 3 | 3 |
| 3 | 3 | 3 | 3 | 3 | 3 | 3 | 3 | 3 | 3 | 3 | 3 | 3 | 3 | 3 | 3 |
| 0 | 0 | 0 | 0 | 3 | 3 | 3 | 3 | 3 | 3 | 3 | 3 | 3 | 3 | 3 | 3 |
| 0 | 0 | 0 | 0 | 0 | 0 | 0 | 1 | 3 | 3 | 3 | 3 | 3 | 3 | 3 | 3 |

CONFIG_BASE =

| | | | | | | | |
|---|---|---|---|---|---|---|---|
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |
| 0 | 0 | 0 | 0 | 3 | 3 | 3 | 3 |

CONFIG_AMB =

| | | | | | | | |
|---|---|---|---|---|---|---|---|
| 1 | 3 | 1 | 1 | 1 | 3 | 1 | 3 |
| 0 | 0 | 1 | 1 | 0 | 3 | 3 | 3 |
| 0 | 0 | 0 | 0 | 0 | 0 | 3 | 3 |
| 0 | 2 | 2 | 1 | 2 | 2 | 1 | 1 |
| 0 | 0 | 0 | 0 | 1 | 1 | 1 | 1 |
| 0 | 0 | 1 | 1 | 1 | 1 | 1 | 2 |
| 0 | 1 | 1 | 1 | 1 | 3 | 3 | 3 |
| 1 | 3 | 1 | 1 | 3 | 3 | 3 | 3 |
| 0 | 0 | 2 | 2 | 3 | 3 | 3 | 2 |
| 2 | 2 | 3 | 3 | 3 | 3 | 3 | 3 |
| 0 | 3 | 3 | 3 | 3 | 3 | 3 | 2 |
| 0 | 1 | 2 | 3 | 3 | 3 | 3 | 3 |
| 2 | 2 | 1 | 1 | 3 | 3 | 3 | 3 |
| 0 | 0 | 0 | 3 | 3 | 3 | 3 | 3 |
| 1 | 1 | 1 | 2 | 3 | 3 | 3 | 3 |
| 0 | 0 | 2 | 3 | 3 | 3 | 3 | 3 |

*FIG. 23*

CONFIG_NN =

| | | | | | | | |
|---|---|---|---|---|---|---|---|
| 0 | 1 | 1 | 1 | 2 | 2 | 1 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 3 | 3 | 3 | 3 | 3 | 3 | 3 | 3 |
| 1 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 1 | 3 | 3 | 3 | 3 | 3 | 3 | 3 |
| 0 | 0 | 3 | 3 | 3 | 3 | 3 | 3 |
| 3 | 3 | 3 | 3 | 3 | 3 | 3 | 3 |

*FIG. 24*

CONFIG_RBF =

| | | | | | | | |
|---|---|---|---|---|---|---|---|
| 0 | 0 | 0 | 0 | 1 | 2 | 3 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 0 | 1 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |
| 3 | 3 | 3 | 3 | 3 | 3 | 3 | 3 |

*FIG. 25*

METHOD OF OPTIMIZATION OF FLOW CONTROL VALVES AND INFLOW CONTROL DEVICES IN A SINGLE WELL OR A GROUP OF WELLS

INTRODUCTION

Oil field reservoir managers are increasingly using more sophisticated methods to control wells that extend through multiple zones. Initially, inflow control devices (ICDs) were used to control the flow of reservoir fluids to a production well. The nozzles of these devices are typically set (or plugged) based on an initial characterization and logging of the reservoir. More recently, "Intelligent" completion products have been used to manage this process. These are known as flow control valves (FCVs) whose inline or annular cross-sectional area can be dynamically changed during the production cycle to control the well flowrate for optimization purposes, for example to limit the water production rate while maximizing the oil quantity.

FIGURES

FIG. 13 is a chart of DC2 Configuration Table (Segment vs. Nozzle Size) with segments by row and Nozzles by column, with 0=none 1=small, 2=med & 3=large.

FIG. 14 is a chart of PI2 Configuration Table (Segment vs. Nozzle Size) with segments by row and Nozzles by column, with 0=none 1=small, 2=med & 3=large.

FIG. 23 is a chart of DC2—AMB Configuration (Segment vs. Nozzle Size) with segments by row and Nozzles by column, with 0=none 1=small, 2=med & 3=large.

FIG. 24 is a chart of DC2-NN Configuration (Segment vs. Nozzle Size) with segments by row and Nozzles by column, with 0=none 1=small, 2=med & 3=large.

FIG. 25 is chart of a DC2—RBF Configuration (Segment vs. Nozzle Size) with segments by row and Nozzles by column, with 0=none 1=small, 2=med & 3=large.

SUMMARY

A method and an apparatus for managing a subterranean formation including collecting information about a flow control valve in a wellbore traversing the formation, adjusting the valve in response to the information wherein the adjusting includes a Newton method, a pattern search method, or a proxy-optimization method. In some embodiments, adjusting comprises changing the effective cross sectional area of the valve. A method and an apparatus for managing a subterranean formation including collecting information about an intelligent control valve in a wellbore traversing the reservoir and controlling the valve wherein the control includes a direct-continuous approach or a pseudo-index approach.

DETAILED DESCRIPTION

It is desirable to control and optimize the production of hydrocarbons from a well, group of wells, or the entire field, using one or more sub-surface valves to control the flow of produced fluids into a wellbore or multiple wellbores. It is also desirable to continuously optimize the control of such valves for some stipulated operational objective, such as maximizing the oil rate while minimizing the water-cut at some downstream sink over a specified period of production. The use of 'inflow control devices' (ICDs) permits this partially, as the effective cross-sectional area, resulting from the design configuration (number and size of nozzles) is subsequently fixed throughout, though it is potentially changeable with certain intervention procedures. The effective cross-sectional area of inline or annular 'flow control valves' (FCV), on the other hand, can be manipulated once installed. Herein, we consider the application and treatment of both valve types, and their use for production optimization. In particular, we control the effective cross-sectional area exhibited by either device that dictates the rate of fluid flow possible in the wellbore. In this way, the procedures developed can be construed as device (ICD or FCV) independent. Indeed, the methods thus apply to any device which presents the means to manipulate and control the effective cross-sectional area. Note that we provide the means to convert an effective cross-sectional area solution to an underlying ICD design configuration by way of mapping functions. These issues will be elaborated in the following.

Figure 27:
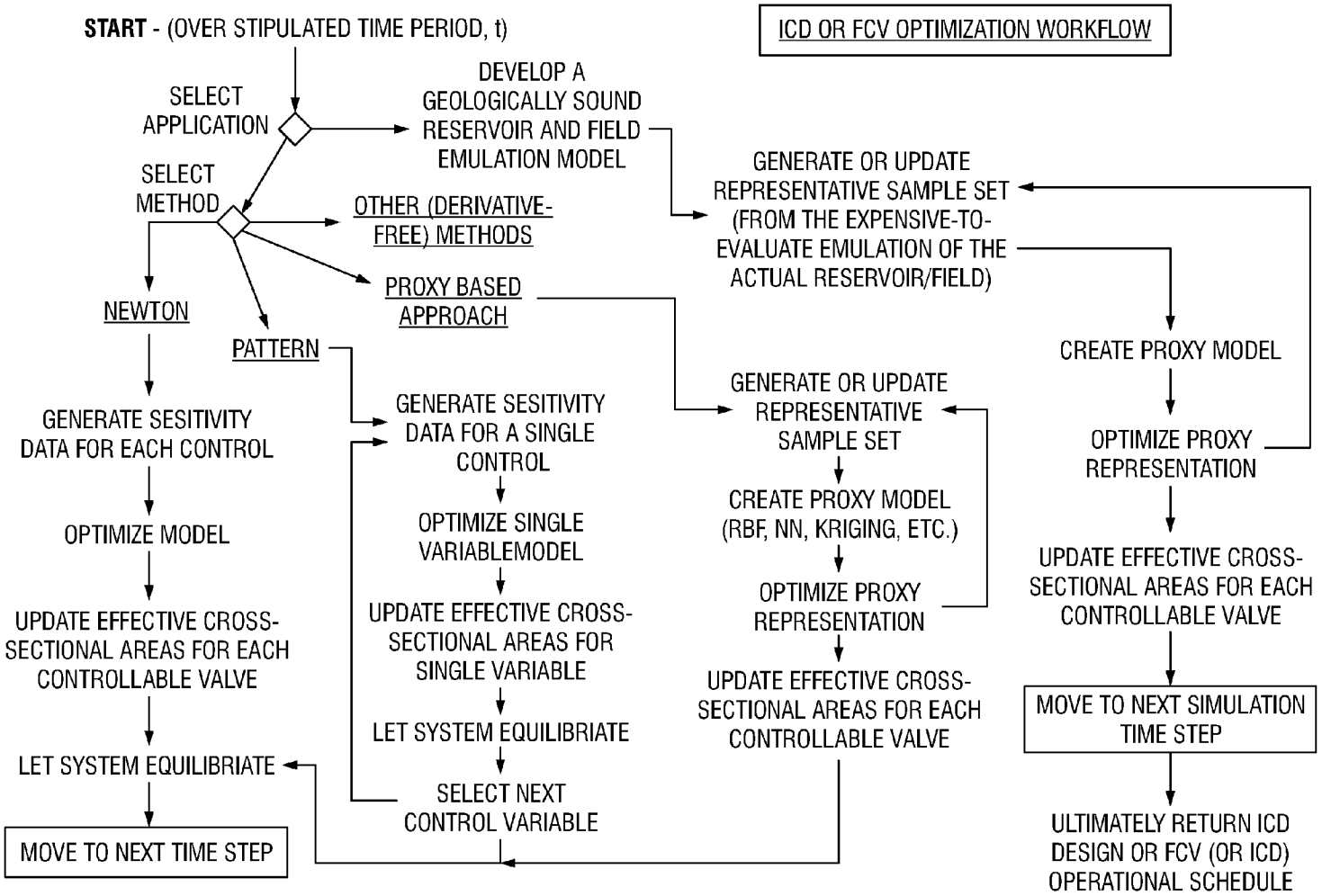
FIG. 27 is an optimization work flow chart

Initially, this application describes the design optimization of inflow control devices (ICDs). It is desirable to optimize the design configuration of inflow control devices (ICDs) in a wellbore model, for example a multi-segment well (MSW) model. In particular, assuming that the number of packers and sections are defined a priori, the number of ICDs, each comprising a number of nozzles of varying sizes, are optimized in each compartment (or section) of the wellbore model in order to maximize a designated merit function. Two particular approaches, direct-continuous and pseudo-index are discussed and simulation results are presented. Note that the optimization procedure concerns the treatment of the effective cross-sectional area as stated above. FIG. 27 provides an ICD and FCV optimization workflow chart. This flow chart represents an embodiment of the ICD or FCV optimization procedure described in this document. Note, that evaluation of the real field necessarily requires the system response to equilibrate. This is assumed in the workflow and should be viewed in conjunction with the details provided herein.

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

The statements made herein merely provide information related to the present disclosure and may not constitute prior art, and may describe some embodiments illustrating the invention.

Initially, a review of multiple inflow control devices is needed. A wellbore model, e.g., multi-segment well (MSW), can be divided into smaller sections by placement of a number of packers. As the end of the well is closed, the utilization of n packers will result in n sections of interest. Consequently, each section can be construed as a compartment (CMPT) within which a certain number of inflow control devices (ICDs) can be placed. In this report, without loss of generality, we assume that up to 4 ICDs per compartment are permitted. We further assume, without loss of generality, that each ICD can be assigned to have 1 to 4 nozzles, where each nozzle can take 3 possible sizes, small (S), medium (M) or large (L). Thus, assuming the well configuration (number and location of packers) is defined a priori (In a larger definition of the problem, the well configuration could also be treated as variable), the ICD configuration problem is concerned with establishing in each compartment, the number of ICDs, the number of nozzles and their respective sizes such that some merit (or objective) function is optimized over the time period of interest. Evidently, the design configuration dictates the effective cross-sectional area presented by each ICD, and this is the quantity that is controlled for optimization purposes.

The merit value of any given design configuration is obtained using the resulting response from a reservoir simulator (as a representation to the real field), such as ECLIPSE™, which is commercially available from Schlumberger Technology Corporation of Sugar Land, Tex. Thus, an optimization procedure will result in a design that maximizes the designated objective function. Notably, as each and every simulation evaluation is time consuming, the efficacy of the optimization procedure is dictated by both the result obtained and the time taken to achieve it. In this way, the ICD design is tuned to best match the changing reservoir conditions over the anticipated life of the well (or field) as typically, they are not adjustable once completed (as opposed to flow control valves which are intended to be adjusted). Hence, the design procedure is critical for effective completion design with ICDs.

Optimization of an instance of the ICD design problem using two particular approaches is described herein. These are referred to as the direct-continuous and pseudo-index methods. The latter is better able to handle the dimensionality explosion encountered with an increasing number of ICDs and nozzles in each compartment as compared to the former, but at the cost of requiring a solution to a higher dimensional optimization problem. When the number of ICDs or nozzles is low, both methods perform comparably well. Various test results are presented below after a discussion of the procedures for one embodiment. Note that the time period may be large (over entire field life) or small (over a shorter operating period). In either case, we refer to this as the time period of interest, over which optimization of the ICDs or FCVs, or some combination thereof, is performed.

In some embodiments, one may consider finding the derivatives of the multiphase flow rates measured at the tubing head of a single well or at a gathering centre for groups of wells with respect to the flow areas of all the flow control valves in all wells contributing to the measured production. This is a real-time field operation (refer to this as Case 1) that involves opening each FCV by a single inflow area setting/position/increment, keeping all other positions fixed and then returning it to the original position. These derivatives can be used to calculate an optimum production setting. For example, the objective function could be to maximize oil production, minimize water production, maximize net present value, etc. For simplicity, set up the optimization problem as a least-squares optimization. The simplest way to do this is to start with an objective function $f(x)$ where the vector x is a set of the areas of each FCV and expand this function about the current position of these areas $x_i$ using Taylor Series expansion. This can be expressed as $$f(x)=f(x_i)+(x-x_i)\nabla f(x_i)+\tfrac{1}{2}(x-x_i)A(x-x_i)+ \quad (1)$$

where A is the hessian, $$A_{ij}=\frac{\partial^2 f}{\partial x_i \partial x_j}\bigg|_{x_i}.$$

If the expansion is truncated after the second order term, the gradient can be defined as $$\nabla f(x)\approx\nabla f(x_i)+A(x-x_i) \quad (2)$$

Then, the Newton method to determine the next iteration point is obtained by solving the system $$x-x_i=-A^{-1}\nabla f(x_i) \quad (3)$$

The Hessian A can be obtained either directly by perturbing the areas of each FCV to obtain numerical second derivatives or by finding an approximation of the inverse Hessian $A^{-1}$. Directly obtaining the Hessian numerically by perturbing the areas of each FCV has two severe disadvantages. First, this would be a very time-consuming operation. Secondly, if the surface of the objective function was not smooth, i.e., continuously differentiable with a bound on curvature, then if there were only a limited number of valve positions available for the FCV, this Hessian may be too coarse and, as such, unusable.

Next, use the solution of the system of equations (3) to change the valve settings of the FCVs thereby attaining a simple optimization of valve settings. Doing this operation and calculation at periodic intervals also allows the valves to operate on a semi-continuous basis which is beneficial for keeping them operating.

Then, to overcome some practical limitations of the scheme above (Case 1), in particular the need to develop single variable sensitivity profiles before any optimization can be performed (and indeed the cost involved to do so), one can instead apply a pattern search procedure. This means that, given a starting (or base) configuration, the full system (either actual field or representative field model) can be perturbed for a selected variable only. This can be done in a systematic manner so as to minimize the number of valve changes necessary (Case 2). The configuration yielding the best resulting objective value (once the system dynamics have settled) is selected as the next prevailing operating condition. The process repeats, but this time selecting the next variable of interest. Thus, the pattern search procedure offers the following advantages: it enables a line search to be made with respect to a single variable (so it is an univariate analysis as indicated by Case 1 above using the information available), however, it allows for discrete position selection, minimizes the valve changes necessary (ensuring reliability), and provides an improving sequence of iterates towards a locally convergent solution that can easily accommodate operational constraints. Note that the recorded iterates can be retained for proxy model construction (as indicated below).

An alternative process could be to use flow rates vs. control valve inflow areas data to generate (or train) a proxy function of the desired objective (Case 3). This analytical proxy objective could then be optimized for by obtaining an optimal set of inflow areas, x, using an appropriate solver, e.g., a mixed-integer nonlinear program (MINLP) solver in the case of discrete variables as observed for multi-position FCVs. Running that optimal set, x, on the actual valves will lead to an actual objective function that may or may not match with the proxy one. If it is not matching, the new actual flow rate reading obtained from using the optimal set x are incorporated into the training set to improve the proxy and optimize it again. This process continues till we obtain a match between the actual objective function and its optimized proxy. Doing this operation and calculation at periodic intervals also allows the valves to operate on a semi-continuous basis which is beneficial for keeping them operating and not seizing up.

If a model for the reservoir exists, a reservoir simulator and an optimization program can be used to calculate changes in the inflow areas of each FCV in addition to optimization of other field operating parameters, or use the method described above for changing the FCV settings and optimize other field operating parameters with the simulator and optimizer.

If a model for a reservoir exists, a reservoir simulator coupled to a proxy-based optimizer capable of handling mixed integers (e.g., MINLP) may be used to assist in devising a more efficient and possibly optimal setting of FCV tests, if the number of valid FCV permutations is large.

An additional embodiment, which includes a real-time method to optimally control a set of FCVs within a single well or a group of wells, is the following. First, obtain derivatives of the measured multiphase flow at the tubing head of a single well or at a gathering point of a group of wells by finding derivatives of these flow rates with respect to the inflow area of each control valve in each well that is contributing to these measured flow rates.

If the FCV has discrete positions, this is accomplished by advancing the open position of each control valve by 1 position, waiting for the flow rates to stabilize at the tubing head or gathering point and recording them, then moving the position of the control valve back to the original point. If the valve is wide open, then obtain the derivative by going backward one position, recording the flow rates and then returning to the fully open position. The operation above is accomplished one position at a time while the other positions are kept fixed.

An alternative is to advance forward by 1 position, record the surface data, adjust backward by 1 position, record the data and then return to the original position, if the current position of the valve allows this. This will obtain a more accurate derivative of the surface phase flow rates with respect to the inflow area of the particular valve. An analysis can be done to determine where the most sensitive valve settings are in the system. At these particular valves, carry out the extended operation to find the more accurate derivative with respect to the inflow area of that valve. Elsewhere, only find the simpler one-sided derivative.

If the FCV has continuous inflow area settings, then a sensitivity study must be done to determine the accuracy and resolution of the measured surface flow rates with respect to the FCV inflow area settings.

This can be done for each valve in the system unless a sensitivity analysis suggests that the settings of some valves are not important.

The time required to do this may be multiple hours based on the time limitations of changing the valve settings, the time needed for the surface flow rates to stabilize, the number of FCVs and whether some more accurate derivatives are required. It is anticipated that a complete cycle of events required to obtain derivatives of surface flow rates with respect to all FCV inflow areas may take 24 hours or more depending on the response times of the FCVs. This could be automated to some extent.

A check must be made to determine whether surface flow rates return to their original values when the FCV settings are reset to their original positions. Crossflow may affect the ability of the system to return to unperturbed rates.

Next, once derivatives have been obtained, formulate an objective function and find the minimum/maximum of this function. The control or decision variables of the minimization/maximization problem are the inflow area settings of each FCV. For example, a simple least-squares procedure (or a more sophisticated algorithm) can be used to find the changes in the inflow areas of all FCVs that will maximize oil production. These changes can then be applied to all control valve inflow area settings.

The solution of this problem will yield a set of changes for each inflow area of each FCV. If the device only has discrete settings, then a threshold would likely have to be used to filter these changes, i.e., map them back to the available positions on the FCVs, or, more rigorously optimal, a mixed-integer non-linear programming method can be used to perform the optimization.

The above cycle can be repeated as often as desired. For example, an operator might decide to change the valve settings if some operational constraints are not met, for example, the water cut surpassing a limit.

Now, consider a pattern search procedure that can be applied in real time. Given a current starting configuration:

- Perturb the system (either actual field or a representative model) in one dimension only, which is akin to a line search procedure for a continuous variable and a number of discrete evaluations for an integer variable. The best perturbed configuration is selected and set as the next iterate. In the case of many discrete valve settings or for a continuously varying valve, a polynomial model can be constructed using a subset of the number of positions available for this purpose.
- The procedure continues with selection of a new variable search direction (as indicated above) and the same process is applied.
- The procedure repeats until all variables have been cycled.
- The solution obtained may not be quite converged, so the process returns to the first variable, as indicated above, and repeats the procedure described above. Note that the order of variable selection can be randomized.

This approach has the benefit of gradually, but continuously, optimizing the system under investigation. It can accommodate operating constraints by way of the merit value assigned to each configuration evaluated. It will adjust dynamically to prevailing changes in the system conditions (which will not impair the optimization procedure) and lastly, the method is scalable. However, to account for the interdependence of variables directly (i.e., perform multivariate optimization) the procedure could be replaced with a derivative-free method (say, the downhill simplex method) that could handle integer variables. In addition, for time expediency and to enable application of a MINLP solver, a proxy model could be constructed with the data generated once practical to do so.

An alternative real-time method to optimally control a set of FCVs within a single well or a group of wells is the following:

a. Obtain enough data in the form of flow rates vs. control valve inflow areas to generate (or train) a proxy function of the objective function.
   i. A minimum amount of data could be made of (N+1) points, which will constitute an initial linear approximation of the objective function, where N is the problem dimensionality, e.g., number of valve area positions). This initial sampling could take other forms known to the art, including random Monte Carlo sampling with an arbitrary set of points. Since this operation is to be conducted real-time, it is clear that a minimum time intervention in obtaining such points is recommended, thus a minimum set of (N+1) points is desirable.
   ii. The first data point to construct the proxy could be the starting (or base) configuration of this operation, i.e., the corresponding flow rates and the inflow control valve areas.

b. Once enough data is obtained and the proxy is generated, this analytical proxy objective could then be optimized for by obtaining an optimal set of inflow areas, X.
   i. This optimization operation can be accomplished by running an optimization solver on the proxy function of the objective function, solving for the optimal set of inflow areas of the valves. In general, with or without discrete settings for the inflow areas, a generic mixed-integer nonlinear programming solver could be used. In the case of continuously varying inflow areas, a non-derivative or derivative-based solver could also be used. This includes the provision to manage constraints, if applied.

c. Having obtained the optimal set X, setting that optimal set on the actual valves will lead to an actual objective function that may or may not match with the proxy one. If it is not matching, the new actual flow rates obtained from using the optimal set X are incorporated into the training set, as described in (a), to improve the proxy and optimize it again, as described in (b). This process continues till we obtain a match between the actual objective function and its optimized proxy. This convergence insures that we have obtained the new set of valve inflow areas that will optimize the actual objective function.
   i. The solution of this optimization problem will yield a set of changes for each inflow area of each FCV.

d. The above cycle a., b. and c. can be repeated as often as desired. For example, a reservoir engineer might decide to change the valve settings if some operational constraints are not met, for example, the water cut surpassing a limit. The constraint requirement can be updated accordingly.

If a reservoir simulation model for the reservoir exists, the above operations can be enhanced or replaced with the use of a reservoir simulator and an optimization program that can change parameters within a reservoir simulation.

The reservoir simulator can perform a predictive simulation of the field from beginning to any point in time in the future. The optimization program can repeatedly run this predictive simulation and optimize the update frequency of the FCV valves in addition to optimization of any number of field operating variables such as well BHP/THP, well rates, etc. Valve settings are determined by the calculation described above or, without that pre-requisite, by non-derivative based optimization.

The reservoir simulator can history-match up to present time and then do a prediction over a prescribed period of time, e.g., 1 year. The optimization program can repeatedly run this predictive simulation to optimize and update the FCV valve settings in addition to other operating variables as described above.

If a reservoir simulation model for the reservoir exists, a reservoir simulator and an optimization program can predict the FCV valve settings in addition to other field operating variables. There is no need to go through a real-time cycle of changing all FCV inflow area settings as described above. This can be done once with a prediction and optimization of the entire life of the field or the simulator can be used to history-match to present time and then predict forward for a prescribed period where the optimizer will repeatedly run the simulator through the prediction period in order to optimize all FCV valve settings in addition to other field operating parameters.

If a reservoir simulation model for the hydrocarbon asset exists, a reservoir simulator coupled to a proxy-based optimizer capable of handling mixed integers may be used to assist in devising a more efficient, and possibly optimal, set of FCV tests if the number of valid FCV permutations is large and time limited. One may be able to rank the outcomes of such simulation results against a pre-determined baseline (for example, all FCV's are fully open). The objective function should, therefore, mimic the quantity being observed in the field (i.e., total oil or liquid rate change). The application of an optimizer enables one to establish a ranked list of which settings deliver the greatest change in the desired observable over both full and/or restricted regions of the FCV settings solution space. This step allows one to then identify which FCV setting provides the steepest or most information-rich derivatives.

Generally, for further information, the data gathered in such a real field operation can be construed as being obtained from an 'expensive' to evaluate function, where 'expensive' means that it takes a great deal of time to evaluate (e.g., many hours). Thus, as field evaluation is expensive, it would be advantageous to minimize the number of evaluations required to get to an optimal objective function value. Thus the introduction of pattern search and proxy-based schemes.

As an example of the Case 1 approach, let us assume that we have only two control valves, each with a certain inflow area. These two inflow areas are the control variables. With this assumption, one needs to evaluate at least two times the number of different inflow area positions to obtain the initial, directional, one-sided derivatives. Note that if the inflow area position settings are continuous, one needs to pick some discrete positions. Again, for the sake of discussion, let us assume that each inflow valve has four possible area positions. In that case, we need to evaluate our 'expensive' function eight times; those eight 'points', (x,y) pairs in this 2-D problem, are eight values of the control variable vectors resulting in eight evaluations of the flow rates F(x,y).

The pattern search (Case 2) is simply trying to use the same amount of information, but now gathered in a more efficient way. In our example here, let us say that the four positions of each inflow area are (x0, x1, x2, x3) and (y0, y1, y2, y3), respectively, for our two control valves. In Case 1, for the sake of discussion again, one evaluates F(xi,y0) and then F(x0,yi), for example, to form the x and y axes (8 evaluations in total) of our box of 16 possible values, which would have also included the cross-derivatives. In the pattern search approach, one would first evaluate F(xi,y0) (4 evaluations) and then F(xopt,yi) (4 evaluations). In other words, you are trying, already in your data gathering steps, to look at the best values possible for F(x,y) based on the best line search, as opposed to pre-selected arbitrary directions. In 2-D, this may not appear desirable, but in higher dimensions (10-D) this is advantageous. In addition, if there are many settings for a given variable, a curve fitting exercise can help minimize the number of samples required to identify the maximum in that line direction (a proxy in one dimension, if you will).

As for the proxy approach, from scratch as opposed to coupled with the pattern search above, the idea is to start with only 3 'points' in our 2-D problem, i.e., 3 evaluations of flow rates F(x,y); as opposed to eight evaluations in Case 1, you could obtain, say, F(x0, y0), F(x3, y0), F(x0, y3) to start. (This ensures a linear approximation of F, which dictates the least possible number of necessary samples). Using a Radial Basis Function proxy, for example, one then forms an analytical proxy of F over the (x-y) space. A (quick) optimization of this analytical function gives you ~F(xopt, yopt), an approximation of F(xopt, yopt). Running your real oil field evaluator once with those values of xopt and yopt for inflow area positions, you will produce F(xopt, yopt). If F then differs (with a given metric) from ~F, you include that new 'point' F(xopt, yopt) with your initial three points above, retrain your proxy, optimize again over the proxy and get a new ~F(xopt, yopt). And so on. Note that this procedure can be applied to the real field directly or an emulator of that field in the form of representative field simulation.

In the preceding 2-variable example, from an initial set of N+1=3 evaluations, five more expensive evaluations will have the same initial cost of Case 1 (and where it is understood that the proxy evaluation and optimization are negligible compared to the cost of real field (simulation) evaluations). Will F=~F at that point? Probably not for such a low dimension problem. But imagine a 10-dimensional problem (N=10 control valves) with continuous openings or 10 discrete openings each. In this last case, Case 1 will require at least 100 expensive evaluations to start with, whereas the proxy method will start from (N+1=11) evaluations and will have 89 samples to spare to reach an optimal F solution. This approach works very well indeed for expensive-to-evaluate simulation-based functions and should work equally well for real field-based ones. Moreover, if the control valves have continuous settings, the proxy approach would have a clear advantage, especially in high dimension cases.

Finally, note that not only do both the pattern search (Case 2) and the proxy-based scheme (Case 3) provide objective function improvements with each 'new' evaluation (in this case, the stable state solution of a field configuration or the evaluation of a representative reservoir simulation), but they can do so while accounting for any operational constraints additionally imposed (e.g., separator or capacity limits), that may also be expensive-to-evaluate (i.e., depend on the outcome of the real field or simulator solution, e.g., wellhead temperature limits or hydrate formation, etc.). Thus, as the initial scheme (Case 1) could be limited with respect to these considerations, as well as the extensive time requirement expected to reach a solution, the pattern search and proxy scheme are preferred (with or without a representative reservoir simulation).

The preceding section was concerned with optimization of FCV over a particular time period of interest. The smaller the time period, the closer the procedure is akin to providing continuous control. In this section, we consider optimization of the ICDs. These devices, unlike FCVs, are typically invariant after the design change. Thus, the design is established (over a longer time period) at the outset. While some modern embodiments permit ICDs to be modified and tuned with intervention at some cost, we can conceptually reduce the operational control of such ICDs to the foregoing developments described for FCVs. This concerns the treatment of the effective cross section area settings, as well as its associated design configuration. In the following we therefore consider only the conventional ICD design optimization problem over some time period of interest for some desired merit function. In particular, two methods are described, the Direct-Continuous and the Pseudo-Index approaches. These are elaborated below.

Single ICD Unique Combinations

In one embodiment, an ICD can hold up to 4 nozzles. Each nozzle can take one of three sizes; small (s), medium (m) or large (l). This results in 120 combinatorial designs. Classifying these according to the effective cross-sectional area (the sum of individual nozzle areas) and removing those very close in value, results in 35 unique combinations. The 35 unique combinations for a single ICD are listed in rank order in the Table 4. Note that the last column in the table indicates the effective cross-sectional area of the design (i.e., choice of nozzles).

TABLE 4

Single ICD Unique Configurations

| Index | Noz-1 | Noz-2 | Noz3 | Noz4 | Area ($ft^2$) |
|---|---|---|---|---|---|
| 1 | 0 | 0 | 0 | 0 | 0.0 |
| 2 | 0 | 0 | 0 | 1 | 0.00002164 |
| 3 | 0 | 0 | 1 | 1 | 0.00004328 |
| 4 | 0 | 0 | 0 | 2 | 0.00005284 |
| 5 | 0 | 1 | 1 | 1 | 0.00006493 |
| 6 | 0 | 0 | 1 | 2 | 0.00007448 |
| 7 | 1 | 1 | 1 | 1 | 0.00008657 |
| 8 | 0 | 1 | 1 | 2 | 0.00009612 |
| 9 | 0 | 0 | 2 | 2 | 0.00010567 |
| 10 | 1 | 1 | 1 | 2 | 0.00011776 |
| 11 | 0 | 1 | 2 | 2 | 0.00012732 |
| 12 | 0 | 0 | 0 | 3 | 0.00013526 |
| 13 | 1 | 1 | 2 | 2 | 0.00014896 |
| 14 | 0 | 0 | 1 | 3 | 0.00015691 |
| 15 | 0 | 2 | 2 | 2 | 0.00015851 |
| 16 | 0 | 1 | 1 | 3 | 0.00017855 |
| 17 | 1 | 2 | 2 | 2 | 0.00018015 |
| 18 | 0 | 0 | 2 | 3 | 0.00018810 |
| 19 | 1 | 1 | 1 | 3 | 0.00020019 |
| 20 | 0 | 1 | 2 | 3 | 0.00020974 |
| 21 | 2 | 2 | 2 | 2 | 0.00021135 |
| 22 | 1 | 1 | 2 | 3 | 0.00023138 |
| 23 | 0 | 2 | 2 | 3 | 0.00024094 |
| 24 | 1 | 2 | 2 | 3 | 0.00026258 |
| 25 | 0 | 0 | 3 | 3 | 0.00027053 |
| 26 | 0 | 1 | 3 | 3 | 0.00029217 |
| 27 | 2 | 2 | 2 | 3 | 0.00029377 |
| 28 | 1 | 1 | 3 | 3 | 0.00031381 |
| 29 | 0 | 2 | 3 | 3 | 0.00032336 |
| 30 | 1 | 2 | 3 | 3 | 0.00034501 |
| 31 | 2 | 2 | 3 | 3 | 0.00037620 |
| 32 | 0 | 3 | 3 | 3 | 0.00040579 |
| 33 | 1 | 3 | 3 | 3 | 0.00042743 |
| 34 | 2 | 3 | 3 | 3 | 0.00045863 |
| 35 | 3 | 3 | 3 | 3 | 0.00054105 |

Nozzle sizes: 0 = none 1 = Small 2 = Medium 3 = Large

Direct-Continuous Results

In this section, the direct-continuous method is demonstrated using a reservoir simulation optimization application developed at Schlumberger-Doll Research (SDR). A financial objective function (see parameters in Table 5) is utilized. This objective uses a zero discount rate and a bigger offset value due to the history period utilized during the evaluation procedure. The effective cross-sectional area is optimized for each ICD.

The results are presented in Table 6 for the 2 ICD per segment problem (DC2) using the three different solvers available for this disclosure. This includes the application of the downhill simplex method (or amoeba) solver (AMB) directly, and in conjunction with neural network (NN) or radial basis function (RBF) proxy schemes. The proxy-based schemes are the same as those described above (in the Case 3 description).

Figure 4:
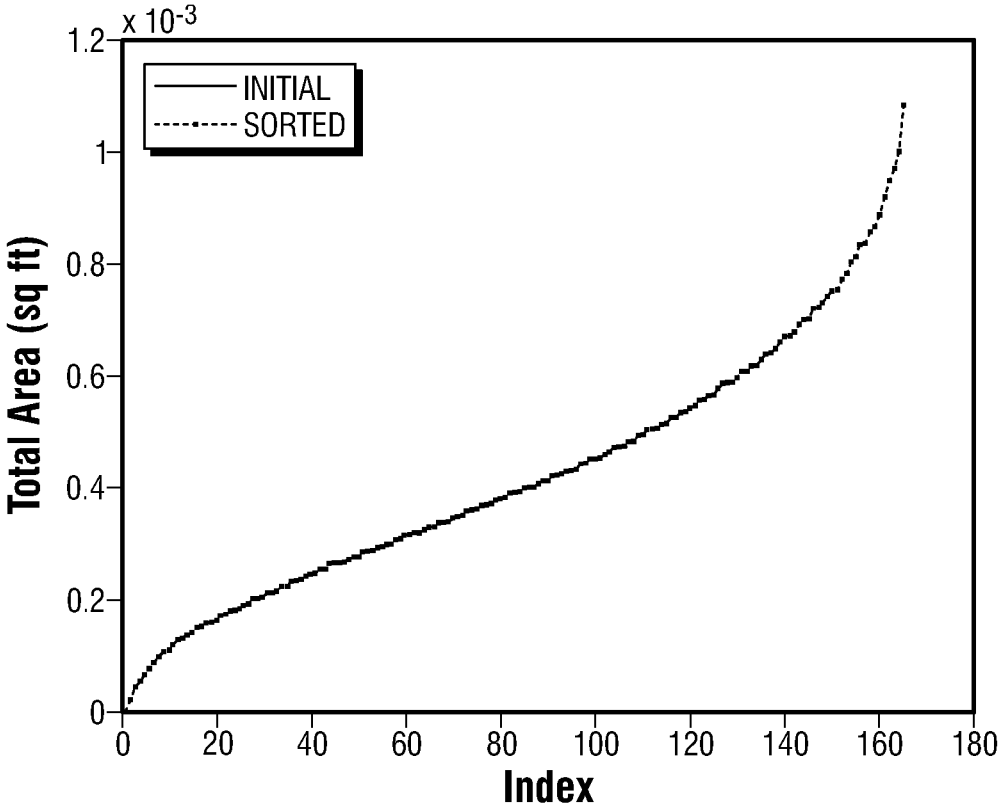
FIG. 4 is a plot of unique dual ICD configurations by Index.

Evidently, the proxy-based schemes out-perform the derivative-free amoeba solver demonstrating the utility of a proxy-based approach for expensive simulation-based function optimization. In addition, it is noted that the RBF solver reaches good solutions more readily than the NN, although they both ultimately reach similar values in this example (see Table 6). Finally, the associated nozzle design configurations are available for the BASE, AMB, NN and RBF cases shown in FIGS. 21-25 (using the 2 ICD mapping function shown in FIG. 4 and discussed below).

In summary, the direct-continuous method has been demonstrated using a reservoir simulation optimization application with a modified objective function. The results demonstrate the efficacy of the proxy-based RBF solver and the optimization procedure developed with use of the appropriate Mapping Function (used to convert the effective cross-section area into its equivalent nozzle configuration—see FIG. 2)

TABLE 5

ICD Model Parameters

| Factors | Label | Units | Value |
|---|---|---|---|
| $x_i$ Base value | $X_{base}$ | $ft^2$ | 0.00054105 |
| $x_i$ Lower bound | $X_{low}$ | $ft^2$ | 0.00002164 |
| $x_i$ Upper bound | $X_{high}$ | $ft^2$ | 0.00108210 |
| Oil price | $P_o$ | \$/stb | 72.00 |
| Gas price | $P_g$ | \$/Mscf | 4.50 |
| Oil production cost | $C_o$ | \$/stb | 16.25 |
| Gas production cost | $C_g$ | \$/Mscf | 1.85 |
| Water production cost | $C_w$ | \$/stb | 27.45 |
| Gas injection cost | $B_g$ | \$/Mscf | 0.00 |
| Water injection cost | $B_w$ | \$/stb | 0.00 |
| Fixed operating cost | D | \$/month | $5 \times 10^6$ |
| Discount rate | r | % | 0% |
| Simulation Offset | | \$B | 173.5 |

$D_t$ is defined as the apportioned fixed cost over time period t of the fixed monthly operating cost D.

TABLE 6

DC2 Results

| Solver | ICDs/seg | Variables | Evaluations | $F_{opt}$ (B\$) | Gain (%) |
|---|---|---|---|---|---|
| AMB | 2 | 16 | 76 (halted) | 1.187 | 34.7 |
| NN | 2 | 16 | 59 | 2.156 | 149.0 |
| RBF | 2 | 16 | 61 | 2.158 | 149.2 |

AMB is the downhill simplex method. NN and RBF define neural network and radial basis function proxy methods with the AMB solver, respectively. The gain (by percentage) is evaluated from the BASE value of 0.866 B\$ (defined by the starting configuration).

Developing the Mapping Function and Optimization Approaches Effective Cross Sectional Area The ICD design optimization problem can be described by the following simulation-based objective function:

$$\max F(X|\rho)$$

$$s.t.\ x_i \in [A_{min}, A_{max}^{m}]$$

$$i \in [1, n]$$

$$x_i \in \mathbb{R}, \tag{1}$$

where ρ represents the properties of the reservoir model and all related parameters necessary for its evaluation. Here, X is the vector of effective cross sectional areas in each of the is n compartments defined in the problem. Note that the number of segments is defined by a multi-segment well (MSW) model. Moreover, it is assumed that the simulation model provided is sufficiently detailed to capture the behavior of the fluid through the sub-surface rock matrix into the MSW. Clearly, this is a pre-requisite prior to any optimization, the purpose of which is to identify the optimal effective cross-sectional area for inflow in each grid block of the MSW and its associated, realizable, ICD configuration given the design constraints imposed. In addition, the i-th component of X ($x_i$) is bound between the lower ($A_{min}$) and upper ($A_{max}^{m}$) values of the effective cross-sectional area. The term effective is used since up to 4 nozzles of 3 possible sizes can be defined within each ICD. Thus, while $A_{min}$ remains unchanged, $A_{max}^{m}$ will vary according to the upper number of ICDs permitted in each compartment (m). For example, the upper effective area for 1 ICD is given by 4 large (L) nozzles ($A_{max}^{1}$=0.00054105 ft$^2$) and by 8L nozzles for 2 ICDs ($A_{max}^{2}$=0.00108211 ft$^2$). The upper effective area for 3 and 4 ICDs is similarly defined. The nozzle and ICD cross sectional areas are summarized in Table 7. Note that the values presented are for demonstrative purposes.

TABLE 7

| Cross section areas | | |
|---|---|---|
| Parameter | Nozzles | Area (ft$^2$) |
| Nozzle Area | | |
| $A_{noz}^{S}$ | S | 0.00002164 |
| $A_{noz}^{M}$ | M | 0.00005284 |
| $A_{noz}^{L}$ | L | 0.00013526 |
| Area Bounds | | |
| $A_{min}^{1}$ | S | 0.00002164 |
| $A_{max}^{1}$ | 4 L | 0.00054105 |
| $A_{max}^{2}$ | 8 L | 0.00108210 |
| $A_{max}^{3}$ | 12 L | 0.00162315 |
| $A_{max}^{4}$ | 16 L | 0.00216420 |

The superscript in $A_{max}^{m}$ indicates the permitted ICD number (m).

Direct-Continuous Approach

The direct-continuous approach is the procedure by which the effective cross-sectional area of each compartment is optimized directly over the permissible continuous domain (i.e., bounded between $A_{min}$ and $A_{max}^{m}$, where m is the permitted number of ICDs in one compartment. However, with this approach, it is necessary to map each (continuous) solution, $x_i$, to its equivalent (discrete) underlying ICD configuration, which is not at all trivial if several ICDs are considered in each CMPT.

Figure 1:
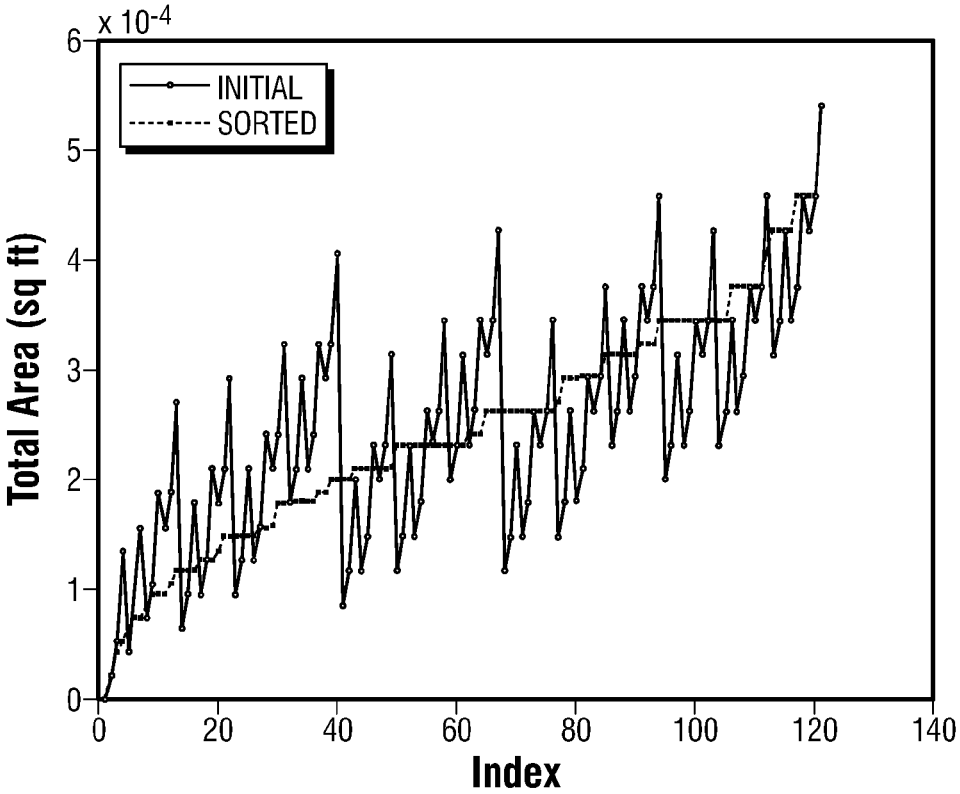
FIG. 1 is a plot of all single ICD configurations by Index.
Figure 2:
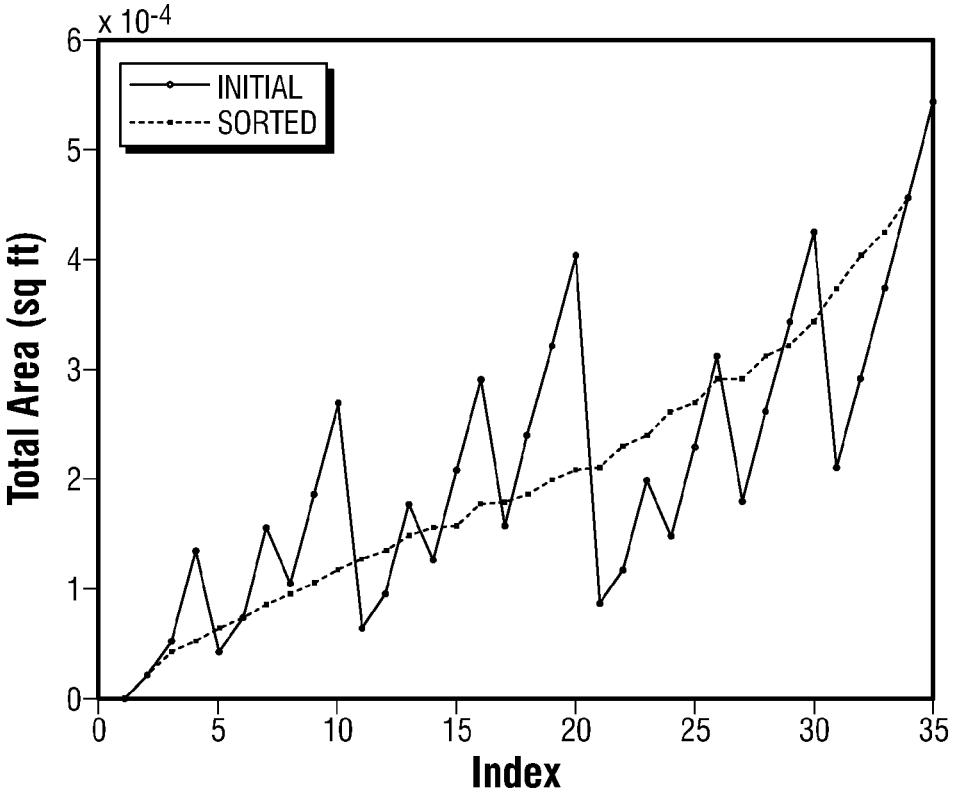
FIG. 2 is a plot of unique single ICD configurations by Index.
Figure 3:
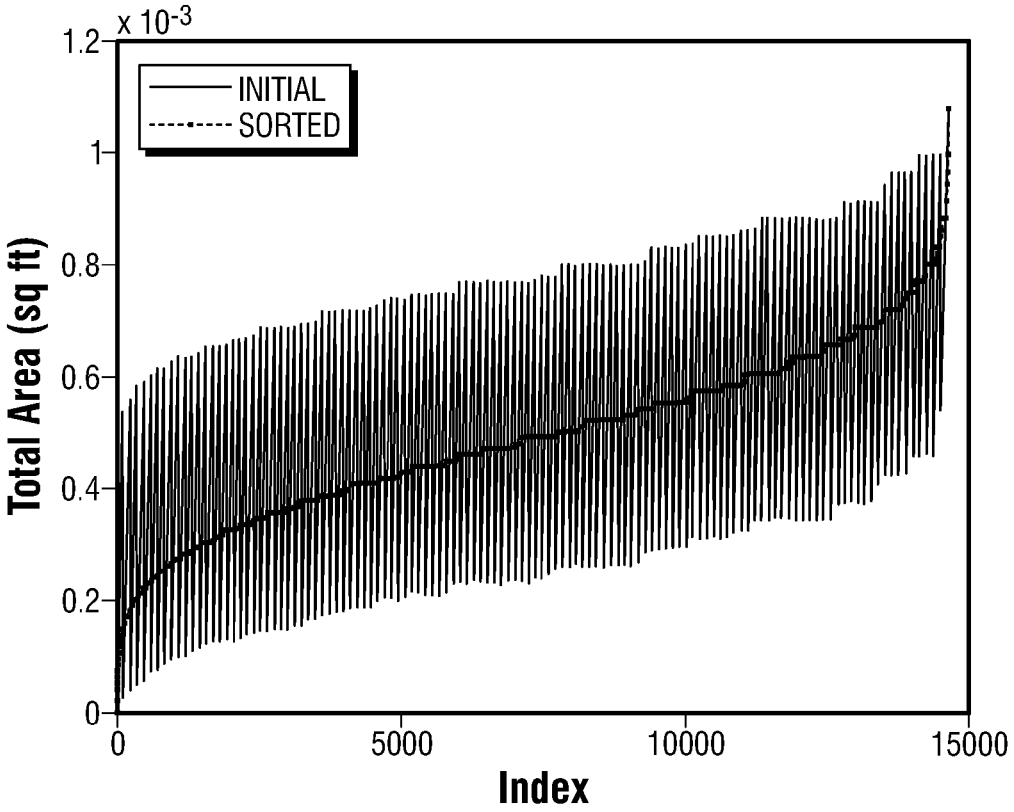
FIG. 3 is a plot with all dual ICD configurations by Index.
Figure 5:
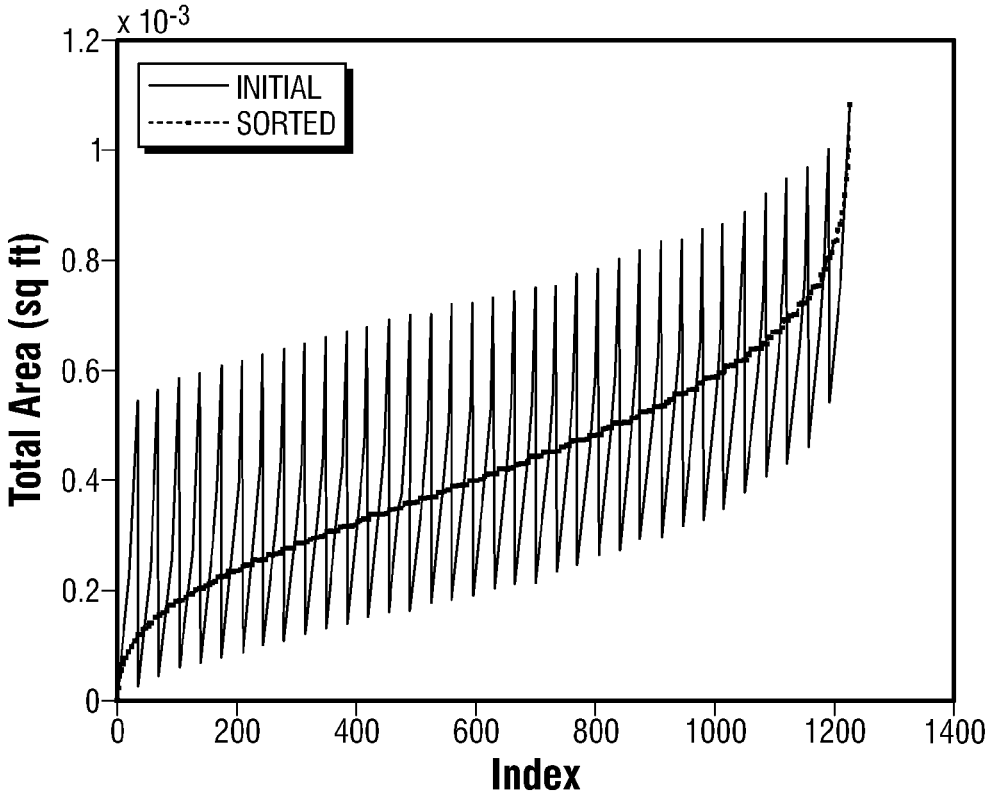
FIG. 5 is a plot of filtered dual ICD configurations by Index.
Figure 6:
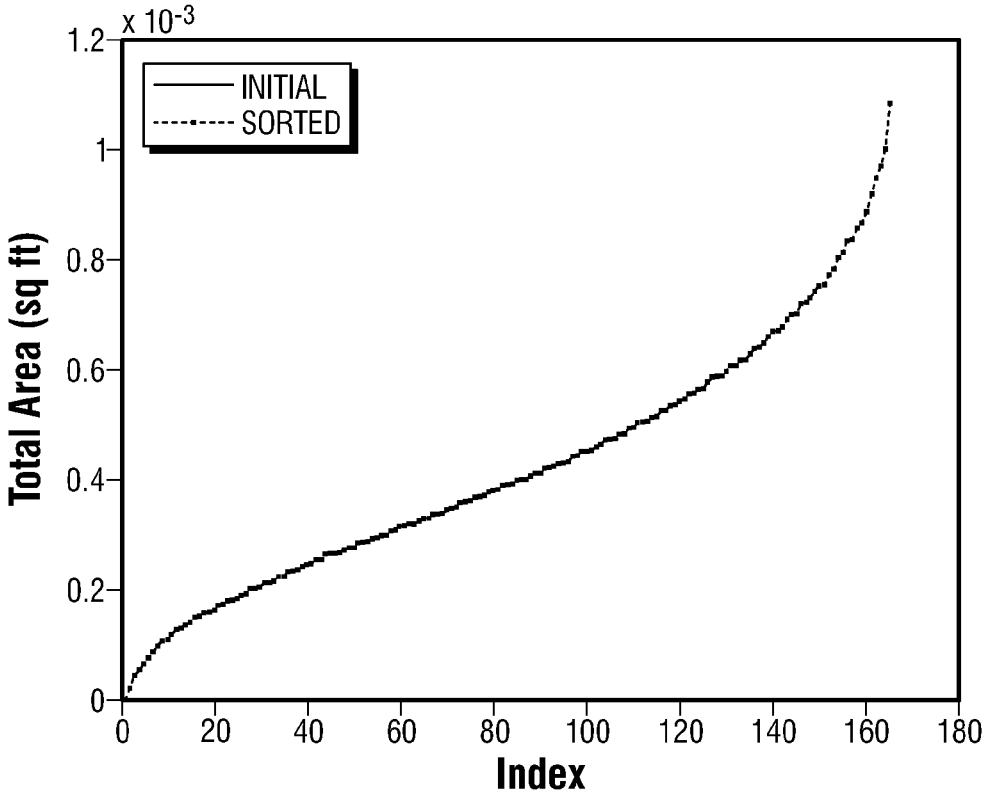
FIG. 6 is a plot of unique dual filtered ICD configurations by Index.
Figure 7:
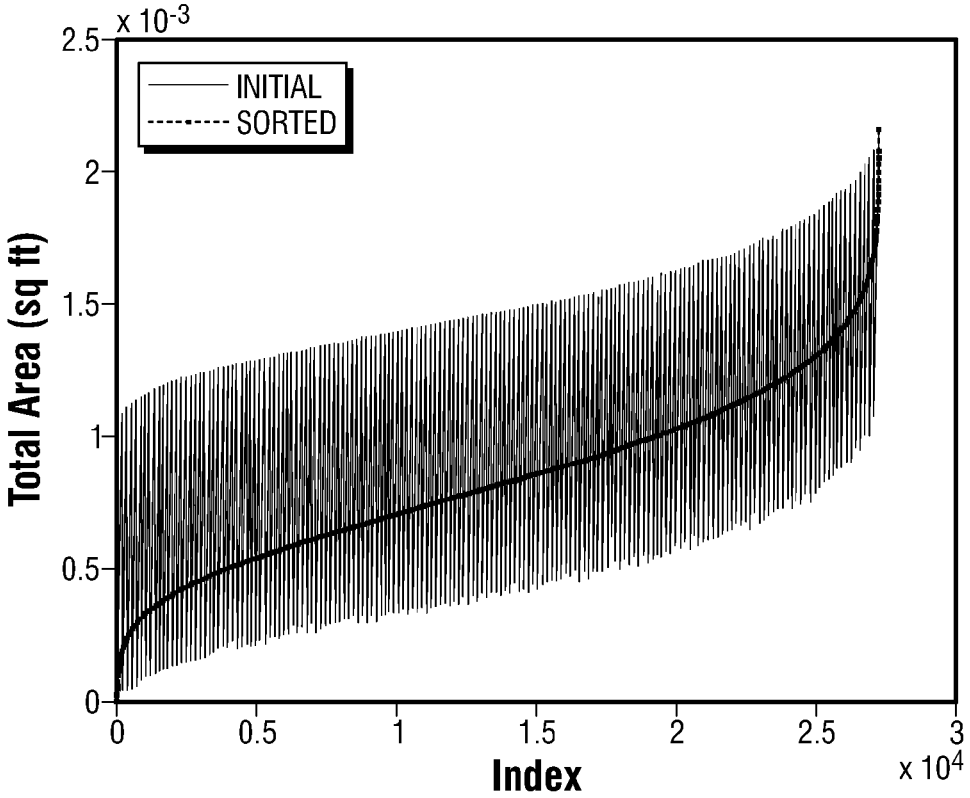
FIG. 7 is a plot of filtered quad ICD configurations by Index.
Figure 8:
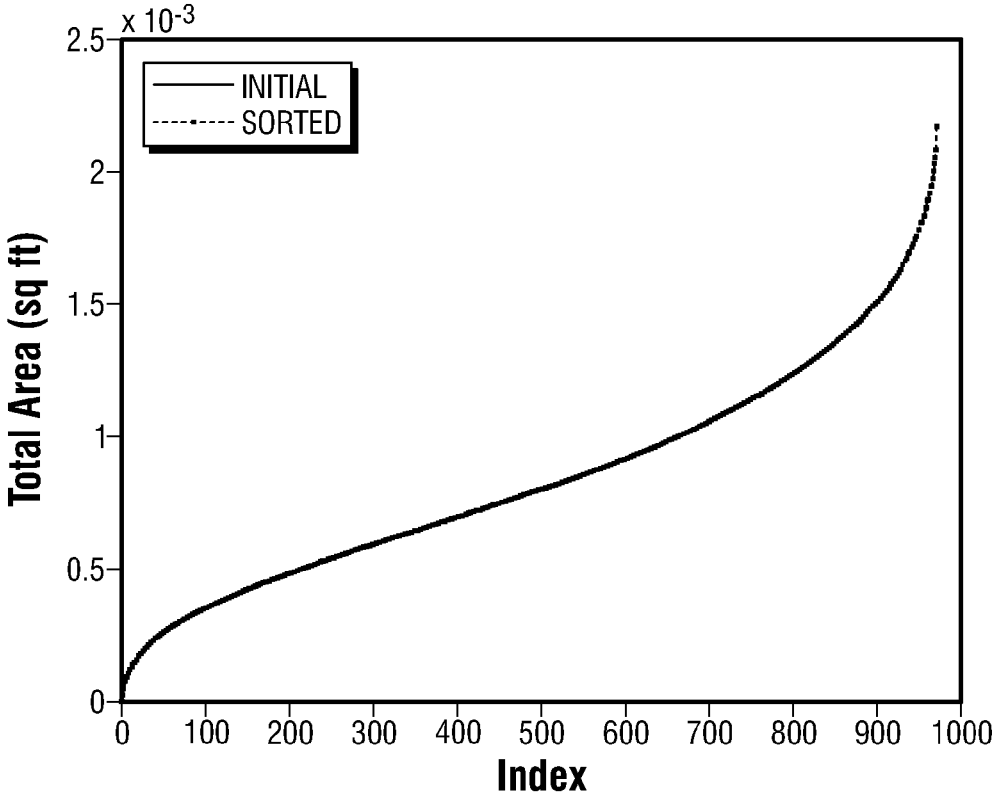
FIG. 8 is a plot of unique quad filtered configurations by Index.

For the single ICD case, there are 120 configurations, ranging from one small (S) nozzle to four large (4L) nozzles. The mapping function (that includes the zeroconfiguration) is shown in FIG. 1. (This mapping function is pivotal in generating the combinations arising with an increasing number of ICDs). Notably, of these 121 configurations (including the zero configuration), there are only 35 unique effective cross-sectional area values (as shown in FIG. 2). Now, while inferring the appropriate configuration for 2 or more ICDs becomes increasingly difficult due to the combinatorial explosion of possible configurations, one means to reduce the complexity is by selecting only the unique configurations. For the dual ICD case, there are $121^2$=14, 641 possible combinations (FIG. 3) with 165 unique cases (FIG. 4) or, using the unique set, there are $35^2$=1,225 dual combinations, again with 165 unique cases. These are shown in FIGS. 5 and 6, respectively. Similarly, using the dual unique set, there are $165^2$=27,225 possible combinations for the quad ICD case (FIG. 7) of which 969 are identified as unique (see FIG. 8).

In the foregoing, we have provided mapping functions for single, dual and quad ICDs comprising only unique combinations (Note that the unique values are based on 10 digit precision, but could be modified, if necessary, leading to slightly differing mapping functions). Thus, the continuous solutions from the optimization problem can be converted to the underlying ICD/nozzle configurations with relative ease using these mapping functions.

The pseudo-index approach aims to avoid the combinatorial complication by considering one variable for each ICD in the segment. This is elaborated in the following section.

Pseudo-Index Approach

The direct-continuous approach is akin to optimizing over the continuous domain (i.e., represented by the y-axis in FIG. 1 for the single ICD case). However, mapping each continuous solution to an underlying ICD configuration is fraught with practical difficulty if many ICDs are considered in each compartment. One means to mitigate this problem is to devise a change in variables and introduce the notion of pseudo-variables giving rise to the pseudo-index approach. The change in variable simply refers to the use of the index variable (call it $y_i$) assigned to the x-axis of a mapping function (see, for example, FIG. 1). The introduction of pseudo-variables concerns partitioning the effective cross sectional area ($x_i$) into components for each permitted ICD. Thus, the i-th effective cross sectional area, which remains the simulation parameter, is defined as follows:

$$x_i = \sum_{j=1}^{m} f(y_{ij}), \tag{2}$$

where $f(.)$ is the function that maps the j-th index variable $y_{ij}$ to its associated cross sectional area, given by $a_{ij}=f(y_{ij})$. As each $y_i$ represents one, and only one, ICD, $y_{ij}$ ranges from 1 to 35, and the mapping function $f(.)$ is compactly described by FIG. 2 (based on linear interpolation between the points). Note also that only the first ICD in each segment has a lower bound of 1, the remaining are 0 to ensure that the smallest effective area is equivalent to one small nozzle). Thus, if $y_i$ is treated as a continuous variable, $a_{ij}$ will cover the range [$A_{min}$ $A_{max}^{1}$] continuously, while if it is treated as an integer variable, only the permissible discrete ICD area values are allowed:

$$\begin{aligned} &\max F(Y|\rho) \\ &s.t.\ y_i \in [I_{min}, I_{max}^{1}] \\ &I_{min}=1\ I_{max}^{1}=35 \\ &i \in [1,n] \\ &y_i \in \mathbb{R}, \end{aligned} \tag{3}$$

$$\begin{aligned} &\max F(Y|\rho) \\ &s.t.\ y_i \in [I_{min}, I_{max}^{1}] \\ &I_{min}=1\ I_{max}^{1}=35 \\ &i \in [1,n] \\ &y_i \in \mathbb{N}. \end{aligned} \tag{4}$$

Definition (3) is a nonlinear programming (NLP) problem, while the more rigorous representation (4) is an integer non-linear programming (INLP) problem. Generally, the INLP problem is harder to solve than the NLP problem due to the nonlinear nature of the typical simulation-based objective function that necessarily requires a proxy-based approach. Adaptive proxy-based methods are often used to accelerate simulation-based optimization problems. However, when integer variables are present, they are absolutely necessary in order to provide a continuous relaxation of the integer problem. That is, a representation of the function must exist at non-integer values. In particular, the solution of an INLP, or generally a mixed-integer nonlinear problem (MINLP), is hampered if the objective function is not sufficiently convex. The continuous NLP, on the other hand, is less sensitive to the potential lack of convexity, especially if a derivative-free optimizer is used.

One important point to note with the pseudo-index approach is that, since each $y_{ij}$ refers to at most a single ICD, the final solution is readily mapped to an underlying and unique ICD design (see FIG. 2). However, the cost of this improvement is increased complexity in the optimization problem. For example, for compartments with m ICDs permitted in each, the direct-continuous problem comprises n variables, whereas the pseudo-index approach will have nm variables. Thus, in the particular case of 16 compartments with up to 2 ICDs, the direct-continuous approach will have 16 variables, each requiring conversion to one in $35^2$=1,225 possible combinations, whereas the pseudo-index approach will have 32 variables, each over a simple range (1-35) that is easily converted to the underlying ICD configuration. Moreover, while the number of ICDs cannot readily be increased with the direct-continuous approach, it can with the pseudo-index approach with each additional variable defined over the same simple range (1-35) for a single ICD. The pseudo-index approach also potentially permits treatment of the actual integer problem, as discussed above.

Simulation Archive

Figure 9:
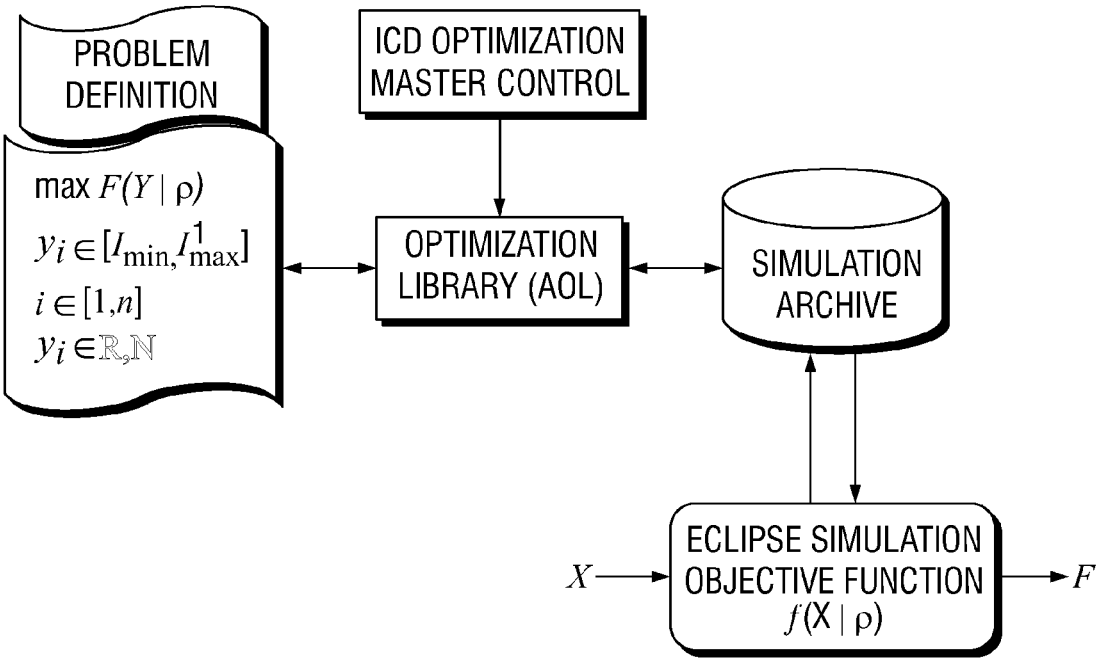
FIG. 9 is a flow chart of an embodiment of an ICD optimization framework.

In the pseudo-index approach, each ICD represents a control variable in the optimization problem. However, the effective cross sectional area (the actual simulation parameter) is the sum of up to 4 ICDs in each compartment in which the order of the ICDs represented is immaterial. As such, the values of the simulation parameter will re-occur more frequently than would be the case using the direct continuous approach. To overcome this issue, a simulation archive is utilized to store the simulation parameter values and the corresponding objective function value. Thus, prior to evaluation of the simulation-based objective function, the archive is interrogated for the prevailing simulation parameter set. If a record match is found, the objective value is retrieved and the simulation call is obviated. However, if no match is found, the simulation-based objective function is evaluated and is subsequently stored in the archive. This procedure prevents unnecessary and redundant time consuming evaluations of the objective function. Thus, the introduction of the simulation archive specifically benefits any problem with more than one ICD per compartment, and generally, any expensive simulation-based optimization problem. This is also true when uncertainty is considered as part of the problem. FIG. 9 represents the framework developed for the ICD configuration design optimization problem.

Reservoir Simulation

Each objective function evaluation is expensive to evaluate as it requires the solution of a time consuming numerical reservoir simulation. The reservoir simulation comprises a multi-segment well model with 16 compartments (n=16). The objective function is defined as the net present value (NPV) of the produced hydrocarbons (in dollar terms) over a 20-year simulation time period of interest (from T=15,310 to 22,980 days) by controlling the effective cross sectional areas in each compartment ($X \in \mathbb{R}^n$).

The general NPV objective function includes the cost of gas and water injection, as well as the cost of processing the produced oil, water and gas. Also, while the expressions are given in continuous form, the integral quantities are actually obtained using the trapezium rule, applied over the incremental time-steps and instantaneous production data obtained as simulation output. Note that total oil production can be maximized, if desired, by setting the unit price of oil (Pa) to one and setting all other cost factors to zero in the objective function:

$$F(X)=\int_0^T e^{-rt}[\Omega(X,t)-\Psi(X,t)]dt, \tag{5}$$

where $$\Omega(X,t)=P_oQ_o(X,t)+P_gQ_g(X,t), \tag{6}$$

$$\Psi(X,t)=C_oQ_o(X,t)+C_gQ_g(X,t)+C_wQ_w(X,t)+B_gV_g+B_wV_w+D_t \tag{7}$$

and where $X \in \mathbb{R}^n$ is the vector of control variables (the effective ICD cross sectional areas in each CMPT), n is the problem dimensionality, T is the time period of interest, r is the discount rate and $D_t$ is the fixed operating cost apportioned over the incremental time step t. The revenue and cost factors ($P_o$, $P_g$, $C_o$, $C_g$, $C_w$, $B_g$ & $B_w$) are listed in Table 8 together with associated model parameters. The gas and water injection rates ($V_g$ & $V_w$) are both zero in this case and there are no additional constraints (other than the bounds). Note that the control variables are set for the entire simulation time period (T=7,670 days) and do not change at the incremental time-step level. [Note also that a single reservoir simulation takes approximately 90 minutes to evaluate on a desktop with the following specification: Intel Xeon Quad, X5570 at 2.93 GHz, 12.0 GB RAM on a MS Windows Vista 64-bit operating system.]

TABLE 8

ICD Model Parameters

| Factors | Label | Units | Value |
|---|---|---|---|
| $x_i$ Base value | $X_{base}$ | $ft^2$ | 0.00054105 |
| $x_i$ Lower bound | $X_{low}$ | $ft^2$ | 0.00002164 |
| $x_i$ Upper bound | $X_{high}$ | $ft^2$ | 0.00108210 |
| Oil price | $P_o$ | $/stb | 72.00 |
| Gas price | $P_g$ | $/Mscf | 4.50 |
| Oil production cost | $C_o$ | $/stb | 16.25 |
| Gas production cost | $C_g$ | $/Mscf | 1.85 |
| Water production cost | $C_w$ | $/stb | 27.45 |
| Gas injection cost | $B_g$ | $/Mscf | 0.00 |
| Water injection cost | $B_w$ | $/stb | 0.00 |
| Fixed operating cost | D | $/month | $5 \times 10^6$ |
| Discount rate | r | % | 5% |
| Simulation Offset | | $B | 14.0 |

Notes:

A is defined as the apportioned fixed cost over time period t of the fixed monthly operating cost D.

Experimental Results

The ICD model is optimized using a proxy-based solver, RBFLEX, and using the direct-continuous (DC) and pseudo-index (PI) approaches discussed in the previous sections. The results are reported in Table 9 for the dual and quad ICD cases. While the 2 ICD results are comparable, the 4 ICD results are not. The reason for this is that the PI approach results in many control variables sets with the same objective values. Moreover, as the proxy optimizer in the optimization library emulates the relationship of the control variables with the resulting objective function values, the proxy model is necessarily more complicated than that which can be achieved using the effective variables (as per the DC approach). However, this limitation can be removed if the proxy-optimizer is modified to emulate the effective variables with respect to the objective function response (as purposefully recorded in the simulation archive by design). Thus, this procedure will result in good quality proxy models, leading to better results (as obtained with the DC approach) but without the combinatorial design complexity.

The proxy optimizer scheme only permits construction of approximation models of the control variables designated in the problem with respect to the objective function values. Thus, while the, albeit simple, modification required for the PI approach is not presently manageable, it will not deter those versed in the art from implementing it correctly in a new application.

TABLE 9

| RBF Results | | | | |
|---|---|---|---|---|
| Method | ICDs/seg | Variables | Evaluations | $F_{opt}$ (B$) |
| DC | 2 | 16 | 38 | 439.55 |
| PI | 2 | 32 | 40 (56) | 441.07 |
| DC | 4 | 16 | 48 | 440.02 |
| PI | 4 | 64 | 41 (130) | 396.20 |

RBFLEX uses a radial basis function proxy with the (lexicographic) downhill simplex method. The number of objective function calls (not all are evaluations) is given in brackets for the PI cases.

2 ICD Case Plots

Figure 10:
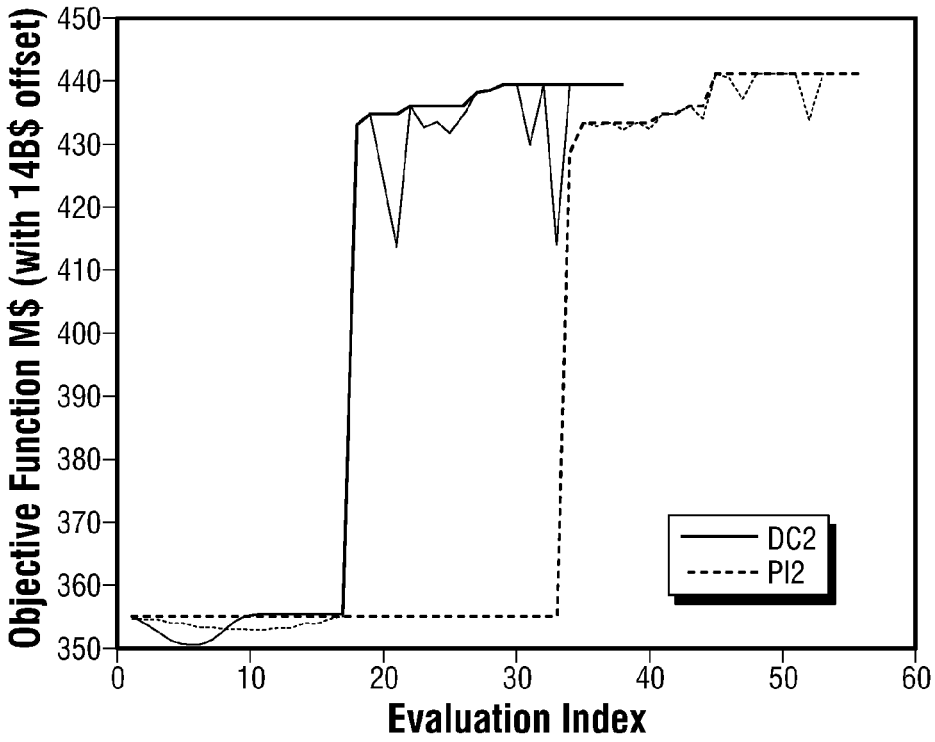
FIG. 10 is a plot of Optimization Performance Profiles-2 ICD cases.
Figure 11:
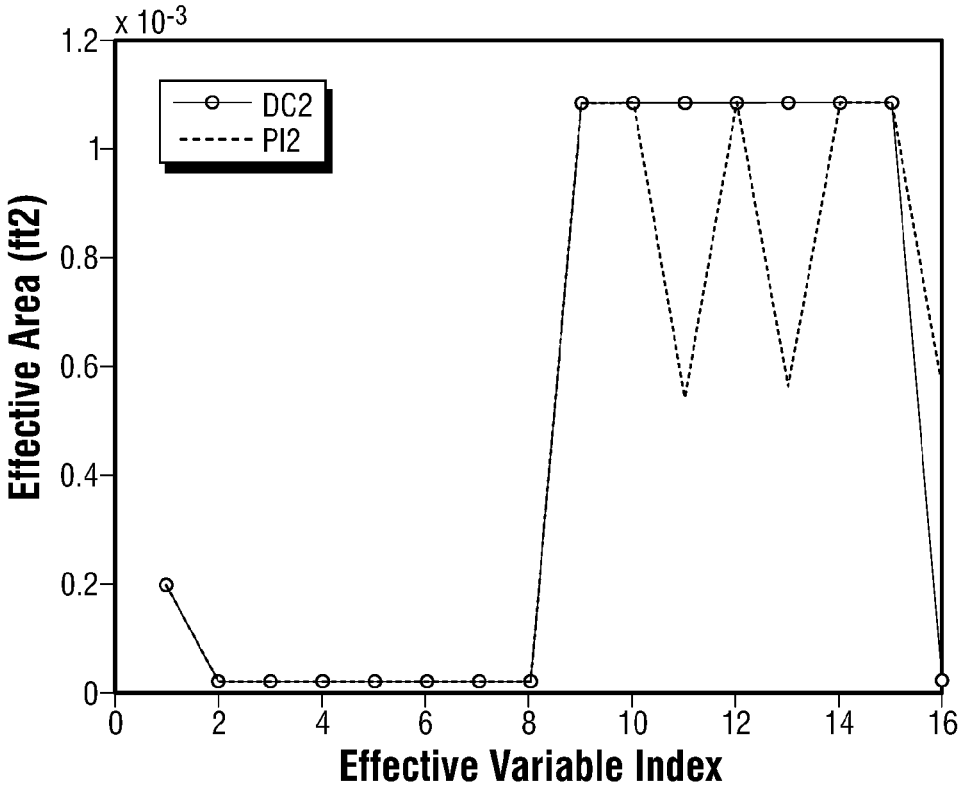
FIG. 11 is a plot of Effective Variables-2 ICD cases.
Figure 12:
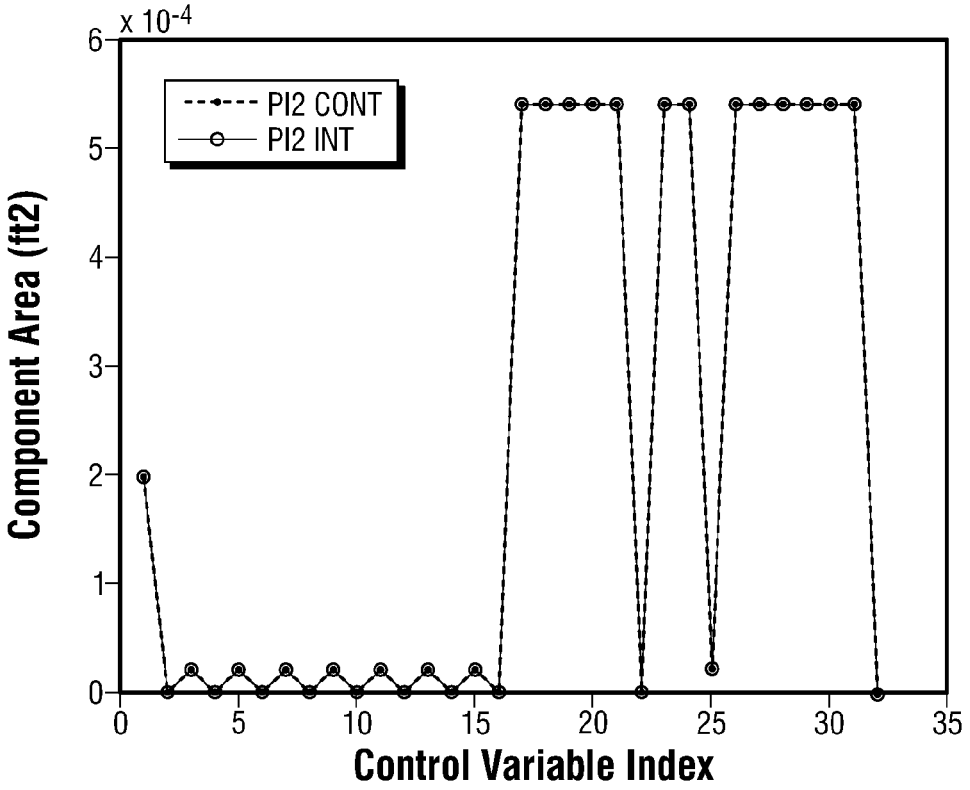
FIG. 12 is a plot of PI2 Control Variables.

The performance profiles for the 2 ICD case are show in FIG. 10. The effective variables are shown in FIG. 11. The continuous (and discrete) control variable sets for PI2 are shown in FIG. 12. Lastly, the nozzle configuration tables for DC2 and PI2 are shown in FIGS. 13 and 14, respectively, where 0, 1, 2 and 3 indicate no nozzle, small nozzle, medium nozzle or large nozzle, respectively.

4 ICD Case Plots

Figure 15:
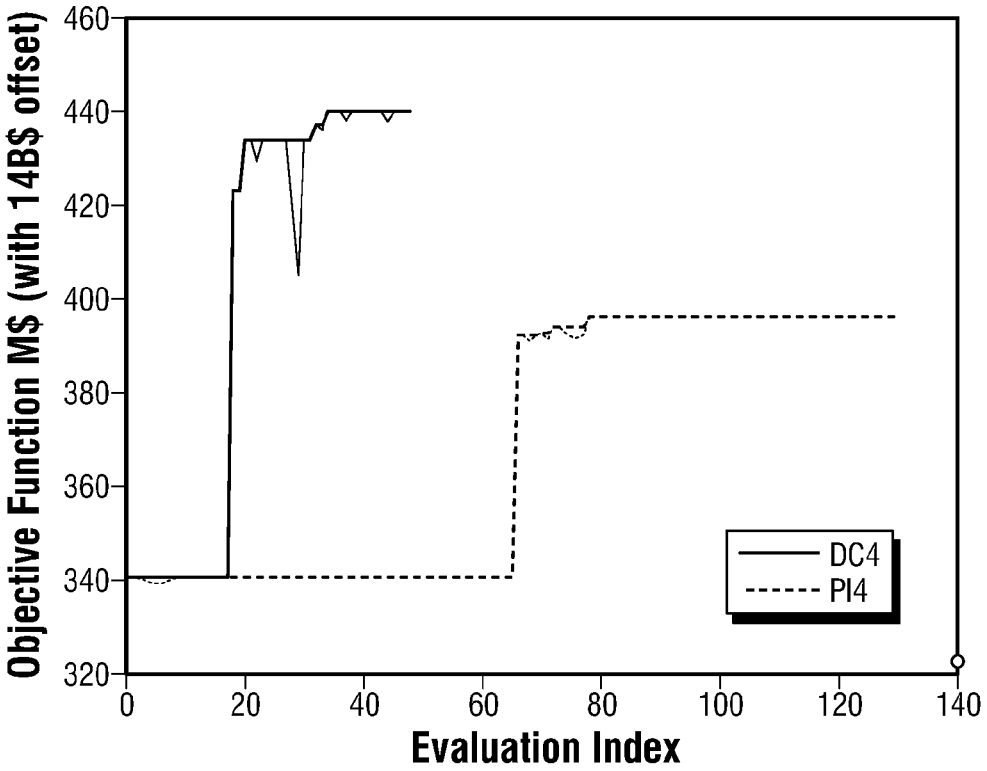
FIG. 15 is a plot of Optimization Performance Profiles-4 ICD cases.
Figure 16:
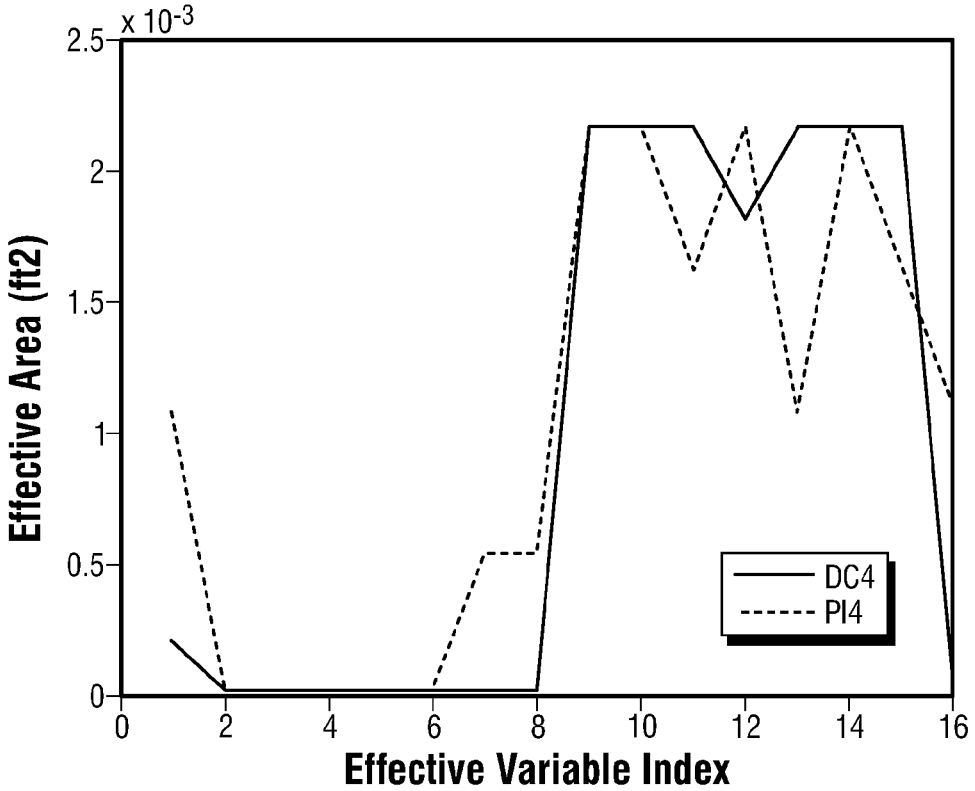
FIG. 16 is a plot of Effective Variables-4 ICD cases.
Figures 17, 18:
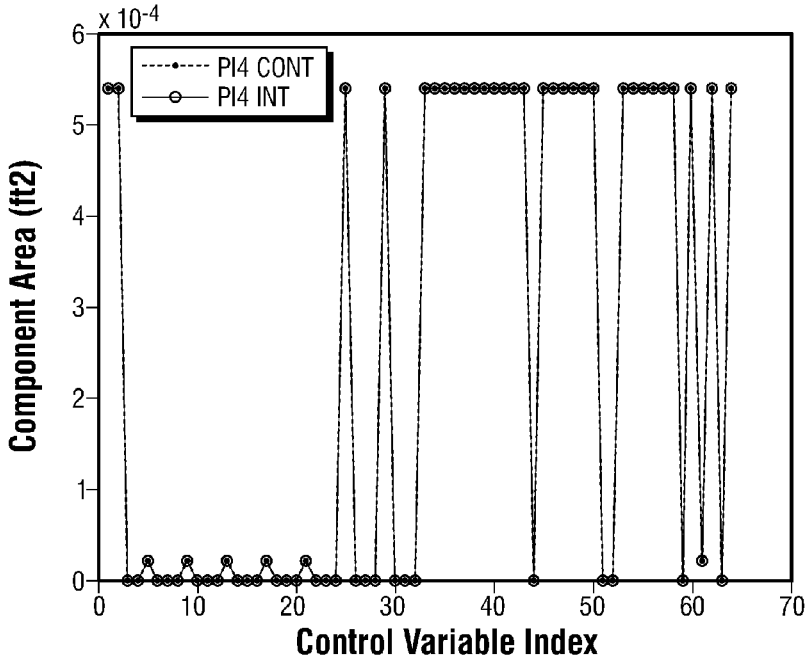
FIG. 17 is a plot of PI4 Control Variables.
FIG. 18 is chart DC4 Configuration Table (Segment vs. Nozzle Size) with segments by row and Nozzles by column, with 0=none 1=small, 2=med & 3=large.
Figures 19, 20:
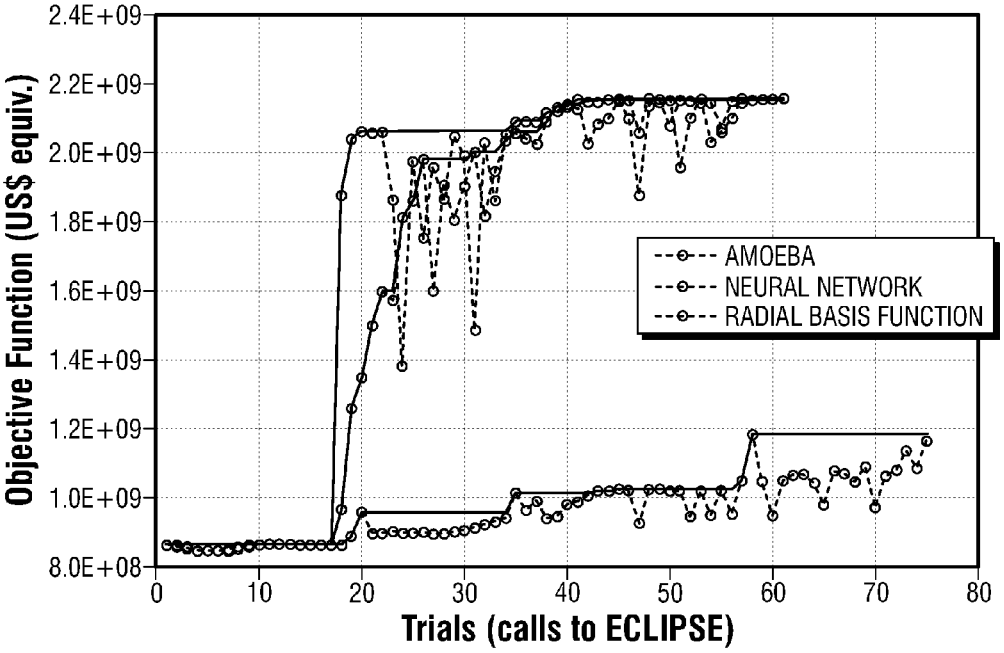
FIG. 19 is a PI4 Configuration Table (Segment vs. Nozzle Size) with segments by row and Nozzles by column, with 0=none 1=small, 2=med & 3=large.
FIG. 20 is a chart of DC2-Profiles.
Figures 21, 22:
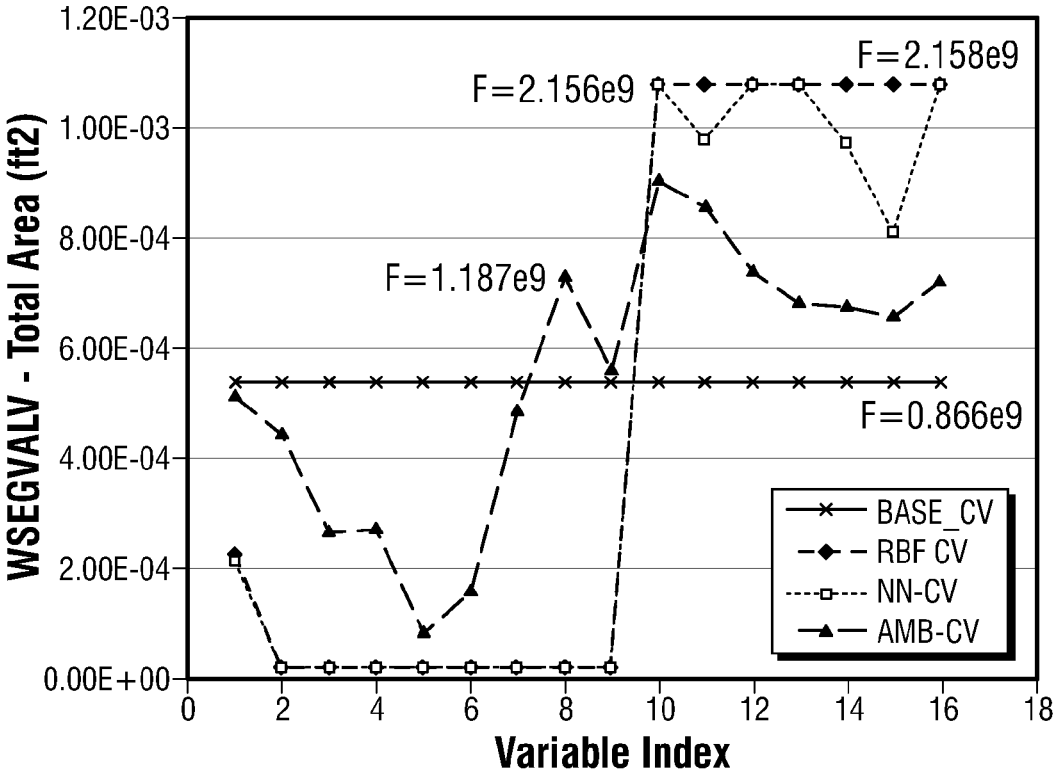
FIG. 21 is a chart of DC2-Effective Variables.
FIG. 22 is a chart of DC2—BASE Configuration (Segment vs. Nozzle Size) with segments by row and Nozzles by column, with 0=none 1=small, 2=med & 3=large.

The performance profiles for the 4 ICD case are show in FIG. 15. The effective variables are shown in FIG. 16. The continuous (and discrete) control variable sets for PI4 are shown in FIG. 17. Lastly, the nozzle configuration tables for DC4 and PI4 are shown in FIGS. 18 and 19, respectively, where 0, 1, 2 and 3 indicate no nozzle, small nozzle, medium nozzle or large nozzle, respectively.

Two methods to manage the ICD optimization problem have been proposed, together with monotonic mapping functions for single, dual and quad ICD nozzle configurations by index. The direct-continuous approach optimizes an NLP and converts the solution to an underlying configuration using the appropriate mapping function. The pseudo-index approach stipulates one control variable for each ICD in the problem, while the effective variables define the actual simulation parameters. The resulting solution is immediately representative of each ICD/nozzle design. Notably, the introduction of pseudo-variables increases the complexity of the optimization problem, but simplifies the combinatorial nature of the possible design space when many ICDs per segment are in contention.

The simulation-based results presented show that both methods perform comparably with few ICDs, but the PI approach is hampered, somewhat, by the nature of the proxy optimization scheme used (which is necessary to manage expensive simulation-based problems efficiently). In particular, instead of emulating the pseudo (control) variables, the effective (simulation) parameters should be modeled. This relatively simple change could provide the means to effectively optimize problems with many ICDs per compartment without fallibility to high dimensional proxy design.

Figure 26:
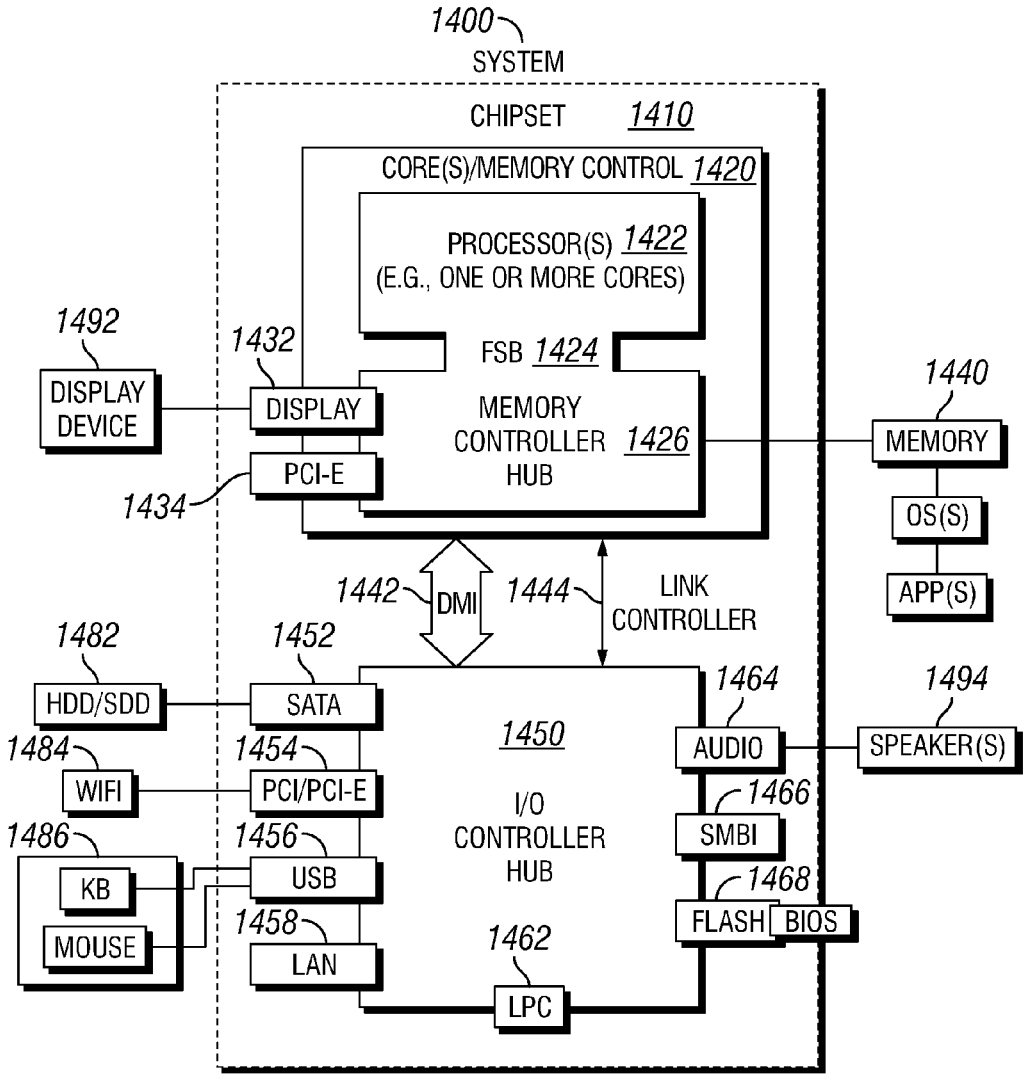
FIG. 26 is flow chart.

FIG. 26 shows a system 1400 that may be used to execute software containing instructions to implement example embodiments according to the present disclosure. The system 1400 of FIG. 26 may include a chipset 1410 that includes a core and memory control group 1420 and an I/O controller hub 1450 that exchange information (e.g., data, signals, commands, etc.) via a direct management interface (e.g., DMI, a chip-to-chip interface) 1442 or a link controller 1444. The core and memory control group 1420 include one or more processors 1422 (e.g., each with one or more cores) and a memory controller hub 1426 that exchange information via a front side bus (FSB) 1424 (e.g., optionally in an integrated architecture). The memory controller hub 1426 interfaces with memory 1440 (e.g., RAM "system memory"). The memory controller hub 1426 further includes a display interface 1432 for a display device 1492. The memory controller hub 1426 also includes a PCI-express interface (PCI-E) 1434 (e.g., for graphics support).

In FIG. 26, the I/O hub controller 1450 includes a SATA interface 1452 (e.g., for HDDs, SDDs, etc., 1482), a PCI-E interface 1454 (e.g., for wireless connections 1484), a USB interface 1456 (e.g., for input devices 1486 such as keyboard, mice, cameras, phones, storage, etc.), a network interface 1458 (e.g., LAN), a LPC interface 1462 (e.g., for ROM, I/O, other memory), an audio interface 1464 (e.g., for speakers 494), a system management bus interface 1466 (e.g., SM/I2C, etc.), and Flash 468 (e.g., for BIOS). The I/O hub controller 1450 may include gigabit Ethernet support.

The system 1400, upon power on, may be configured to execute boot code for BIOS and thereafter processes data under the control of one or more operating systems and application software (e.g., stored in memory 1440). An operating system may be stored in any of a variety of locations. A device may include fewer or more features than shown in the example system 1400 of FIG. 14.

Although various methods, devices, systems, etc., have been described in language specific to structural features and/or methodological acts, it is to be understood that the subject matter defined in the appended claims is not necessarily limited to the specific features or acts described. Rather, the specific features and acts are disclosed as examples of forms of implementing the claimed methods, devices, systems, etc.

What is claimed is:

1. A method for managing a subterranean formation, comprising:

collecting a first set of information comprising a flow rate through a flow control valve of one or more flow control valves in a wellbore traversing the subterranean formation, wherein the flow control valve is in a base position;

adjusting the flow control valve to a second position by opening the flow control valve by a single increment from the base position;

when the flow control valve is in the second position, collecting a second set of information comprising a flow rate through the flow control valve;

adjusting the flow control valve to a third position by closing the flow control valve by a single increment from the base position;

when the flow control valve is in the third position, collecting a third set of information comprising a flow rate through the flow control valve;

generating a proxy function based on the first set of information, the second set of information, and the third set of information;

obtaining an effective cross-sectional area of an inflow area of the flow control valve using a mixed-integer nonlinear program solver on the proxy function;

adjusting, based on the effective cross-sectional area, the inflow area of the flow control valve;

collecting a fourth set of information about the flow control valve, wherein the fourth set of information comprises a flow rate through the flow control valve;

comparing the fourth set of information with proxy information determined based on the proxy function;

training the proxy function based on a determination that the fourth set of information does not match the proxy information to determine an optimized proxy function, wherein the fourth set of information is incorporated into a training set to train the proxy function; and adjusting the flow control valve based on the optimized proxy function.

2. The method of claim 1, wherein the one or more flow control valves comprises a plurality of flow control valves.

3. The method of claim 1, wherein the proxy function is associated with an operational objective selected from the group consisting of: maximizing oil production, minimizing water production, and maximizing net present value.

4. The method of claim 1, wherein the fourth set of information further comprises wellbore data collected for one or more other wellbores.

5. The method of claim 1, wherein adjusting the inflow area of the flow control valve comprises opening or closing the flow control valve.

6. The method of claim 1, wherein adjusting the inflow area of the flow control valve comprises changing the flow rate through the flow control valve.

7. The method of claim 1, wherein adjusting the inflow area of the flow control valve comprises changing the cross-sectional area of the inflow area of the flow control valve.

8. A method for managing a subterranean formation, comprising:

obtaining a first flow rate through a flow control valve of one or more flow control valves in a wellbore traversing the subterranean formation, wherein the flow control valve is in a base position;

adjusting the flow control valve to a second position by opening the flow control valve by a single increment from the base position;

when the flow control valve is in the second position, obtaining a second flow rate through the flow control valve;

adjusting the flow control valve to a third position by closing the flow control valve by a single increment from the base position;

when the flow control valve is in the third position, collecting a third flow rate through the flow control valve;

generating a proxy function associated with an operational objective based on the first flow rate, the second flow rate, and the third flow rate;

obtaining an effective set of inflow areas by running an optimization solver on the proxy function;

setting inflow areas of the one or more flow control valves based on the effective set of inflow areas;

collecting actual flow rates corresponding to the one or more flow control valves;

obtaining an actual objective function based on the actual flow rates;

determining that the actual objective function does not match the proxy function; and based on the determining, incorporating the actual flow rates into a training set to train the proxy function.

9. The method of claim 8, wherein the operational objective is selected from the group consisting of: maximizing oil production, minimizing water production, and maximizing net present value.

10. A system for managing a subterranean formation, comprising:

a processing system of a device comprising one or more processors; and a memory system comprising one or more computer-readable media, wherein the one or more computer-readable media contain instructions that, when executed by the processing system, cause the processing system to perform operations comprising:

collecting a first set of information comprising a flow rate through a flow control valve of one or more flow control valves in a wellbore traversing the subterranean formation, wherein the flow control valve is in a base position;

adjusting the flow control valve to a second position by opening the flow control valve by a single increment from the base position;

when the flow control valve is in the second position, collecting a second set of information comprising a flow rate through the flow control valve;

adjusting the flow control valve to a third position by closing the flow control valve by a single increment from the base position;

when the flow control valve is in the third position, collecting a third set of information comprising a flow rate through the flow control valve;

generating a proxy function based on the first set of information, the second set of information, and the third set of information;

obtaining an effective cross-sectional area of an inflow area of the flow control valve using a mixed-integer nonlinear program solver on the proxy function;

adjusting, based on the effective cross-sectional area, the inflow area of the flow control valve;

collecting a fourth set of information about the flow control valve, wherein the fourth set of information comprises a flow rate through the flow control valve;

comparing the fourth set of information with proxy information determined based on the proxy function;

training the proxy function based on a determination that the fourth set of information does not match the proxy information to determine an optimized proxy function, wherein the fourth set of information is incorporated into a training set to train the proxy function; and adjusting the flow control valve based on the optimized proxy function.

11. The system of claim 10, wherein the one or more flow control valves comprises a plurality of flow control valves.

12. The system of claim 10, wherein the proxy function is associated with an operational objective selected from the group consisting of: maximizing oil production, minimizing water production, and maximizing net present value.

13. The system of claim 10, wherein the fourth set of information further comprises wellbore data collected for one or more other wellbores.

14. The system of claim 10, wherein adjusting the inflow area of the flow control valve comprises opening or closing the flow control valve.

15. The system of claim 10, wherein adjusting the inflow area of the flow control valve comprises changing the flow rate through the flow control valve.

16. The system of claim 10, wherein adjusting the inflow area of the flow control valve comprises changing the cross-sectional area of the inflow area of the flow control valve.

17. A non-transitory computer-readable medium comprising instructions that cause one or more processors to:

collect a first set of information comprising a flow rate through a flow control valve of one or more flow control valves in a wellbore traversing the subterranean formation, wherein the flow control valve is in a base position;

adjust the flow control valve to a second position by opening the flow control valve by a single increment from the base position;

when the flow control valve is in the second position, collect a second set of information comprising a flow rate through the flow control valve;

adjust the flow control valve to a third position by closing the flow control valve by a single increment from the base position;

when the flow control valve is in the third position, collect a third set of information comprising a flow rate through the flow control valve;

generate a proxy function based on the first set of information, the second set of information, and the third set of information;

obtain an effective cross-sectional area of an inflow area of the flow control valve using a mixed-integer non-linear program solver on the proxy function;

adjust, based on the effective cross-sectional area, the inflow area of the flow control valve;

collect a fourth set of information about the flow control valve, wherein the fourth set of information comprises a flow rate through the flow control valve;

compare the fourth set of information with proxy information determined based on the proxy function;

train the proxy function based on a determination that the fourth set of information does not match the proxy information to determine an optimized proxy function, wherein the fourth set of information is incorporated into a training set to train the proxy function; and adjust the flow control valve based on the optimized proxy function.

18. The non-transitory computer-readable medium of claim 17, wherein the one or more flow control valves comprises a plurality of flow control valves.

19. The non-transitory computer-readable medium of claim 17, wherein the proxy function is associated with an operational objective selected from the group consisting of: maximizing oil production, minimizing water production, and maximizing net present value.

20. The non-transitory computer-readable medium of claim 17, wherein the fourth set of information further comprises wellbore data collected for one or more other wellbores.

21. The non-transitory computer-readable medium of claim 17, wherein adjusting the inflow area of the flow control valve comprises opening or closing the flow control valve.

22. The non-transitory computer-readable medium of claim 17, wherein adjusting the inflow area of the flow control valve comprises changing the flow rate through the flow control valve.

23. A system for managing a subterranean formation, comprising:

a processing system of a device comprising one or more processors; and a memory system comprising one or more computer-readable media, wherein the one or more computer-readable media contain instructions that, when executed by the processing system, cause the processing system to perform operations comprising:

obtaining a first flow rate through a flow control valve of one or more flow control valves in a wellbore traversing the subterranean formation, wherein the flow control valve is in a base position;

adjusting the flow control valve to a second position by opening the flow control valve by a single increment from the base position;

when the flow control valve is in the second position, obtaining a second flow rate through the flow control valve;

adjusting the flow control valve to a third position by closing the flow control valve by a single increment from the base position;

when the flow control valve is in the third position, collecting a third flow rate through the flow control valve;

generating a proxy function associated with an operational objective based on the first flow rate, the second flow rate, and the third flow rate;

obtaining an effective set of inflow areas by running an optimization solver on the proxy function;

setting inflow areas of the one or more flow control valves based on the effective set of inflow areas;

collecting actual flow rates corresponding to the one or more flow control valves;

obtaining an actual objective function based on the actual flow rates;

determining that the actual objective function does not match the proxy function; and based on the determining, incorporating the actual flow rates into a training set to train the proxy function.

* * * * *